US010774461B2

(12) United States Patent
Kim et al.

(10) Patent No.: US 10,774,461 B2
(45) Date of Patent: Sep. 15, 2020

(54) LAUNDRY TREATMENT APPARATUS

(71) Applicant: LG ELECTRONICS INC., Seoul (KR)

(72) Inventors: Hyewon Kim, Seoul (KR); Jeaseok Seong, Seoul (KR); Junghwan Lee, Seoul (KR); Kyungah Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 197 days.

(21) Appl. No.: 15/988,518

(22) Filed: May 24, 2018

(65) Prior Publication Data

US 2018/0340288 A1 Nov. 29, 2018

(30) Foreign Application Priority Data

May 24, 2017 (KR) ..... 10-2017-0064246

(51) Int. Cl.
*D06F 39/12* (2006.01)
*D06F 31/00* (2006.01)
(Continued)

(52) U.S. Cl.
CPC ..... *D06F 39/12* (2013.01); *D06F 1/02* (2013.01); *D06F 29/005* (2013.01); *D06F 31/00* (2013.01);
(Continued)

(58) Field of Classification Search
CPC ... D06F 1/02; D06F 1/04; D06F 23/04; D06F 25/00; D06F 29/00; D06F 29/005;
(Continued)

(56) References Cited

U.S. PATENT DOCUMENTS 1,814,698 A * 7/1931 Huber ..... D06F 1/04 68/233
3,026,699 A * 3/1962 Rhodes ..... D06F 37/145 68/12.19
(Continued)

FOREIGN PATENT DOCUMENTS

KR 10-0220751 9/1999
KR 10-0826205 4/2008
(Continued)

OTHER PUBLICATIONS

United States Notice of Allowance dated Nov. 14, 2019 issued in U.S. Appl. No. 15/988,270.
(Continued)

*Primary Examiner* — Joseph L. Perrin
(74) *Attorney, Agent, or Firm* — KED & Associates, LLP

(57) ABSTRACT

Provided is a laundry treatment apparatus which may sequentially perform pre-washing, main washing, drying, and ironing in one place. The laundry treatment apparatus includes: a pre-washer with an accommodation space which accommodates the laundry and has a sink bowl having an open top portion; a main washer which is provided beside the pre-washer; a dryer which is provided beside the main washer; an ironing part which is provided beside the dryer, and has a flat top surface to iron the laundry; a first upper panel which is provided on a top portion of the main washer and the dryer and has a flat top surface; a second upper panel which forms the top surface of the ironing part; and a lid which is provided on a top portion of the pre-washer to open and close the accommodation space.

18 Claims, 27 Drawing Sheets

(51) Int. Cl.

| | |
|---|---|
| ***D06F 1/02*** | (2006.01) |
| ***D06F 29/00*** | (2006.01) |
| ***D06F 1/04*** | (2006.01) |
| ***D06F 25/00*** | (2006.01) |
| ***D06F 39/08*** | (2006.01) |
| ***D06F 33/00*** | (2020.01) |
| *D06F 23/04* | (2006.01) |
| *D06F 37/20* | (2006.01) |
| *D06F 37/22* | (2006.01) |
| *D06F 37/26* | (2006.01) |

(52) U.S. Cl.
CPC ..... *D06F 1/04* (2013.01); *D06F 23/04* (2013.01); *D06F 25/00* (2013.01); *D06F 29/00* (2013.01); *D06F 33/00* (2013.01); *D06F 37/203* (2013.01); *D06F 37/225* (2013.01); *D06F 37/265* (2013.01); *D06F 39/088* (2013.01); *D06F 2204/084* (2013.01); *D06F 2204/088* (2013.01); *D06F 2210/00* (2013.01); *D06F 2222/00* (2013.01)

(58) Field of Classification Search
CPC ..... D06F 31/00; D06F 33/02; D06F 37/203; D06F 37/225; D06F 37/265; D06F 39/088; D06F 39/12; D06F 2204/084; D06F 2204/088; D06F 2210/00; D06F 2222/00
See application file for complete search history.

(56) References Cited

U.S. PATENT DOCUMENTS

| | | | | |
|---|---|---|---|---|
| 3,031,871 | A * | 5/1962 | Bailey | A47L 15/00 68/13 R |
| 3,209,560 | A * | 10/1965 | Shelton | D06F 13/00 68/4 |
| 3,331,226 | A * | 7/1967 | Fink | D06F 29/00 68/20 |
| 5,253,493 | A * | 10/1993 | Ohashi | D06F 39/14 220/812 |
| 6,889,449 | B2 | 5/2005 | Silver | |
| 7,814,770 | B2 | 10/2010 | Jeon et al. | |
| 7,861,436 | B2 | 1/2011 | Kim et al. | |
| 2004/0168481 | A1* | 9/2004 | Usherovich | D06F 25/00 68/13 R |
| 2005/0056059 | A1* | 3/2005 | Usherovich | D06F 39/14 68/12.02 |
| 2009/0139276 | A1 | 6/2009 | Kim et al. | |
| 2009/0235697 | A1* | 9/2009 | Reid | D06F 19/00 68/3 SS |
| 2009/0255300 | A1* | 10/2009 | Doyle | D06F 29/00 68/13 R |
| 2009/0313864 | A1 | 12/2009 | Achterberg et al. | |
| 2010/0294004 | A1* | 11/2010 | Hu | D06F 29/00 68/13 R |
| 2012/0285037 | A1 | 11/2012 | Park et al. | |
| 2014/0292101 | A1* | 10/2014 | Baarman | H02J 50/12 307/104 |
| 2015/0159315 | A1 | 6/2015 | Lim et al. | |
| 2015/0247274 | A1 | 9/2015 | Kim et al. | |
| 2015/0252508 | A1 | 9/2015 | Kim et al. | |
| 2016/0102425 | A1 | 4/2016 | Scheckelhoff | |
| 2017/0037557 | A1 | 2/2017 | Doyle et al. | |

FOREIGN PATENT DOCUMENTS

| | | |
|---|---|---|
| KR | 10-2011-0067888 | 6/2011 |
| KR | 10-2011-0084006 | 7/2011 |
| KR | 10-2013-0022661 | 3/2013 |
| KR | 10-1467752 | 12/2014 |
| KR | 10-2015-0065297 | 6/2015 |
| KR | 10-2015-0092073 | 8/2015 |
| KR | 10-2015-0100498 | 9/2015 |
| KR | 10-2016-0089669 | 7/2016 |

OTHER PUBLICATIONS

United States Office Action dated Jan. 9, 2020 issued in U.S. Appl. No. 15/988,173.
Korean Search Report dated Oct. 2, 2018 issued in Application No. PCT/KR2018/005893.
International Search Report dated Sep. 27, 2018 issued in International Application No. PCT/KR2018/005903.
International Search Report dated Sep. 28, 2018 issued in International Application No. PCT/KR2018/005899.

* cited by examiner

LAUNDRY TREATMENT APPARATUS

CROSS-REFERENCE TO RELATED APPLICATION

This application claims priority under 35 U.S.C. § 119 to Korean Application No. 10-2017-0064246, filed on May 24, 2017, whose entire disclosure is hereby incorporated by reference.

BACKGROUND

1. Field

The present disclosure relates to a laundry treatment apparatus.

2. Background

Generally, washing machines, which sequentially perform washing, rinsing, and spin-drying operations, are typical examples of laundry treatment apparatus. The washing machine may be generally classified as a top-loading washing machine or a front-loading washing machine (also called a drum washing machine). The top-loading washing machine performs washing of the laundry by using a rotating water stream generated in wash water. In contrast, the front-loading washing machine performs washing of the laundry by friction between laundry items that is generated when the laundry items are lifted and dropped by a lifter installed at an inner circumference of a drum.

Further, as clothing materials become more high-quality and diverse, there has been an increasing interest in pre-washing laundry. For example, a special detergent is used to remove old, stubborn stains or to wash functional clothing, and pre-washing may be performed in a washing space provided separately from the washing machine prior to the main washing by the washing machine. In addition, after the main washing is performed by the washing machine, drying and ironing of the laundry may occur.

However, a pre-washing part, a main washing part, a drying part, and an ironing part may be provided separately in different spaces, such that much time is taken from pre-washing to ironing of the laundry, and the laundry may be moved between the separate spaces when pre-washing, main washing, drying, and ironing of the laundry are performed.

BRIEF DESCRIPTION OF THE DRAWINGS

The embodiments will be described in detail with reference to the following drawings in which like reference numerals refer to like elements, and wherein.

DETAILED DESCRIPTION

Hereinafter, a laundry treatment apparatus according to embodiments of the present disclosure will be described with reference to accompanying drawings.

Figure 1:
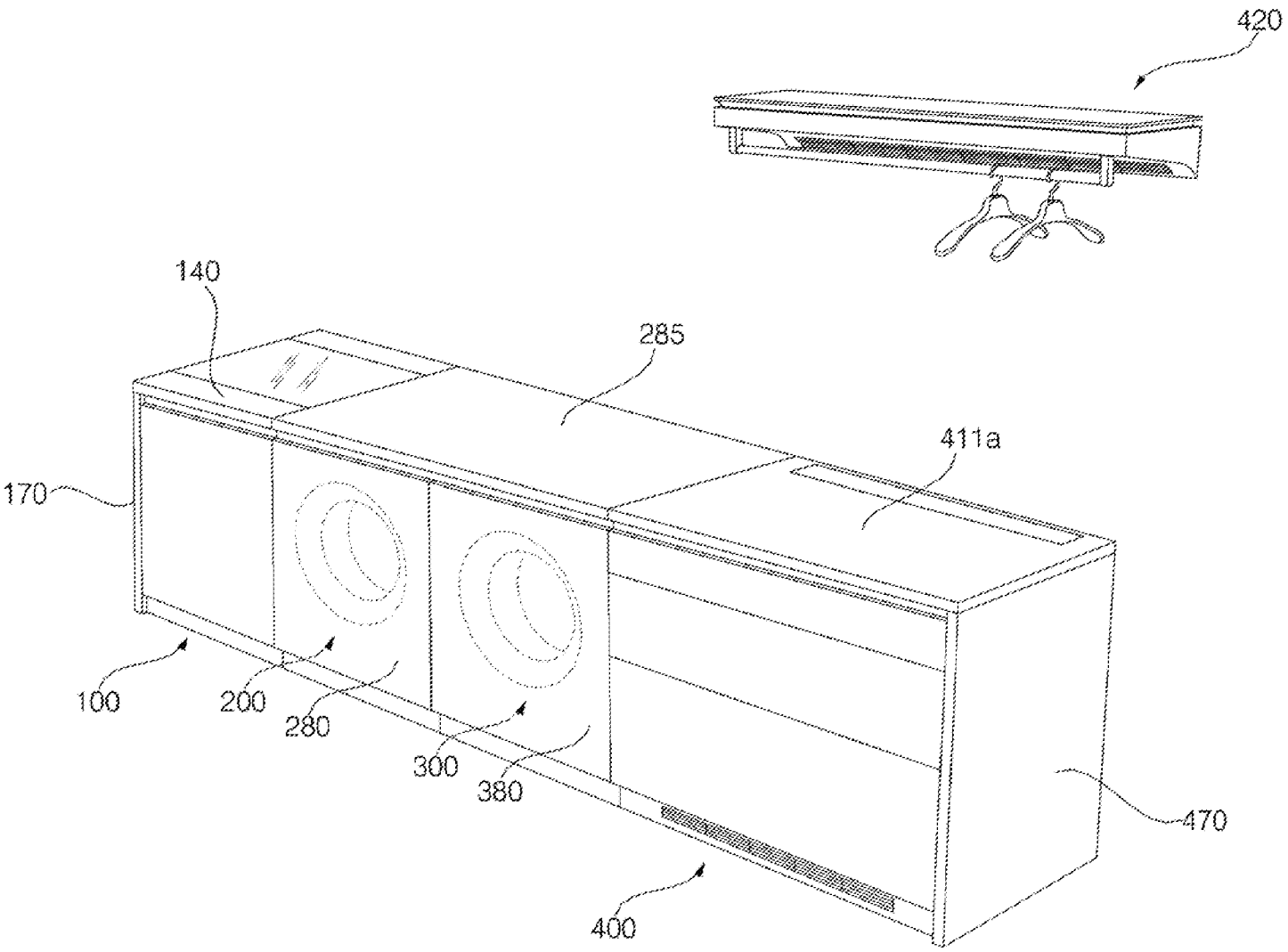
FIG. 1 is a view illustrating a laundry treatment apparatus according to an embodiment of the present disclosure.

FIG. 1 is a view illustrating a laundry treatment apparatus according to an embodiment of the present disclosure. Referring to FIG. 1, the laundry treatment apparatus includes a pre-washer (or pre-washing station) 100, a main washer 200, a dryer 300, and an ironing part (or ironing station) 400. The pre-washer 100, the main washer 200, the dryer 300, and the ironing part 400 may be provided in sequence. For example, the pre-washer 100, the main washer 200, the dryer 300, and the ironing part 400 may be positioned in an order associated with the treatment of the laundry (e.g., first pre-washing, then washing, then drying, and then ironing).

In one example, when the pre-washer 100 is provided on the leftmost side, the main washer 200 may be provided on the right side of the pre-washer 100, the dryer 300 may be provided on the right side of the main washing part 200, and the ironing part 400 may be provided on the right side of the dryer 300. Similarly, when the pre-washer 100 is provided on the rightmost side, the main washing part 200 may be provided on the left side of the pre-washer 100, the dryer 300 may be provided on the left side of the main washing part 200, and the ironing part 400 may be provided on the left side of the dryer 300. As the pre-washer 100, the main washing part 200, the dryer 300, and the ironing part 400 are provided in sequence, a user may sequentially perform rough washing, main washing, drying, and ironing at one place.

A lid 140, which rotates with its rear end serving as a center of rotation to be opened and closed upward and downward, may be provided at a top portion of the pre-washer 100. A sink bowl 120 (see FIG. 3) may be installed at the bottom of the lid 140. An accommodation space 121 (see FIG. 3), which has an open top portion, may be formed at the sink bowl 120. Laundry and wash water may be accommodated in the accommodation space 121 for pre-washing.

The pre-washer 100 may perform pre-washing of the laundry accommodated in the accommodation space 121. Then, the laundry pre-washed by the pre-washer 100 is inserted into the main washer 200 from the front, so that the main washer 200 may perform main washing, rinsing, and dehydrating of the laundry. Subsequently, the dryer 300 may dry the laundry, which is dehydrated by the main washer 200 and is introduced into the dryer 300 from the front. Then, the ironing part 400 may iron the laundry dried by the dryer 300.

A first upper panel 285 may be provided at a top portion of the main washer 200 and the dryer 300. A top surface of the first upper panel 285 may be provided at substantially the same height as a top surface of the lid 140.

A second upper panel 411*a* may be provided at a top portion of the dryer 400. The second upper panel 411*a* may form a top surface of the dryer 400. The top surface of the second upper panel 411*a* may be provided at substantially the same height as the top surface of the lid 140.

As the top surfaces of the lid 140, the first upper panel 285, and the second upper panel 411*a* are provided at substantially the same height, a user may better perceive that the pre-washer 100, the main washer 200, the dryer 300, and the ironing part 400 are integrated as a single element. Furthermore, providing the top surfaces of the lid 140, the first upper panel 285, and the second upper panel 411*a* at substantially the same height allows a user to slide laundry across the top surfaces to minimize lifting of the laundry when moving the laundry between the pre-washer 100, the main washer 200, the dryer 300, and the ironing part 400.

A first side panel 170 may be provided at one side of the pre-washer 100. The first side panel 170 may form one side (e.g., a left side) of the laundry treatment apparatus. Further, a second side panel 470 may be provided at one side (e.g., a right side) of the dryer 400. The second side panel 470 may form the other side of the laundry treatment apparatus.

A first door 280 may be provided at a front portion (or surface) of the main washer 200. The first door 280 may open and close a front lower side of the first upper panel 285. Further, a second door 380 may be provided at a front portion of the dryer 300. The second door 380 may open and close a front lower side of the first upper panel 285. The first door 280 may be provided on the left side of the second door 380, and the second door 380 may be provided on the right side of the first door 280.

The first door 280 may have a left end which is rotatably connected to a cabinet 211 of the main washer 200, so that the first door 280 may be opened and closed back and forth with the left end serving as a center of rotation. Further, the second door 380 may have a right end which is rotatably connected to a casing 310 of the dryer 300, to be opened and closed back and forth with the right end serving as a center of rotation.

Figure 2:
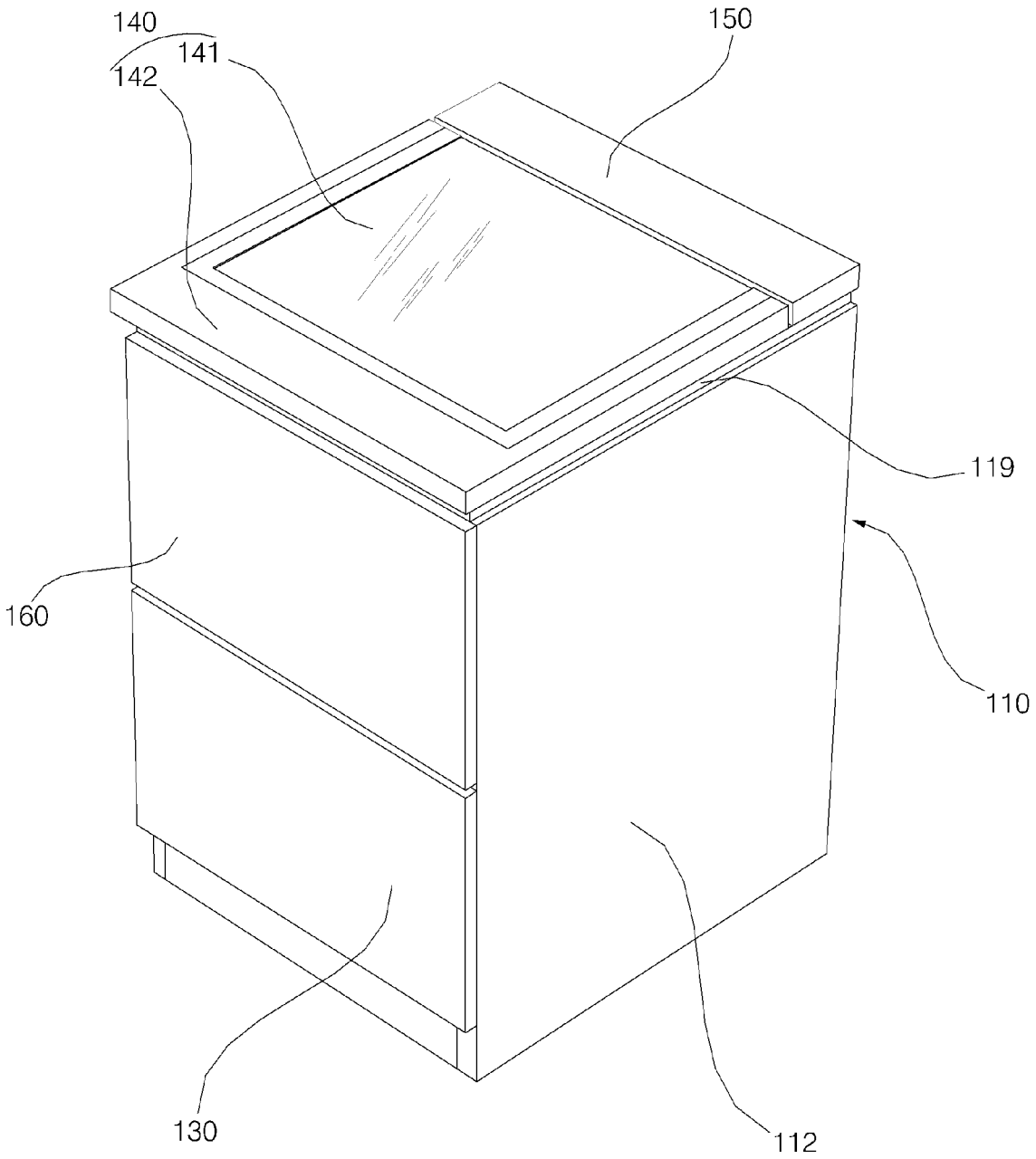
FIG. 2 is a perspective view of the pre-washer illustrated in FIG. 1.

Hereinafter, the pre-washer 100, the main washer 200, the dryer 300, and the ironing part 400 each will be described in detail. The pre-washer 100 may be described as follows. FIG. 2 is a perspective view of the pre-washer 100 illustrated in FIG. 1; and FIG. 3 is a view illustrating an example where a lid 140 illustrated in FIG. 2 is opened and a drawer type washer 130 illustrated in FIG. 2 is drawn out.

Figure 3:
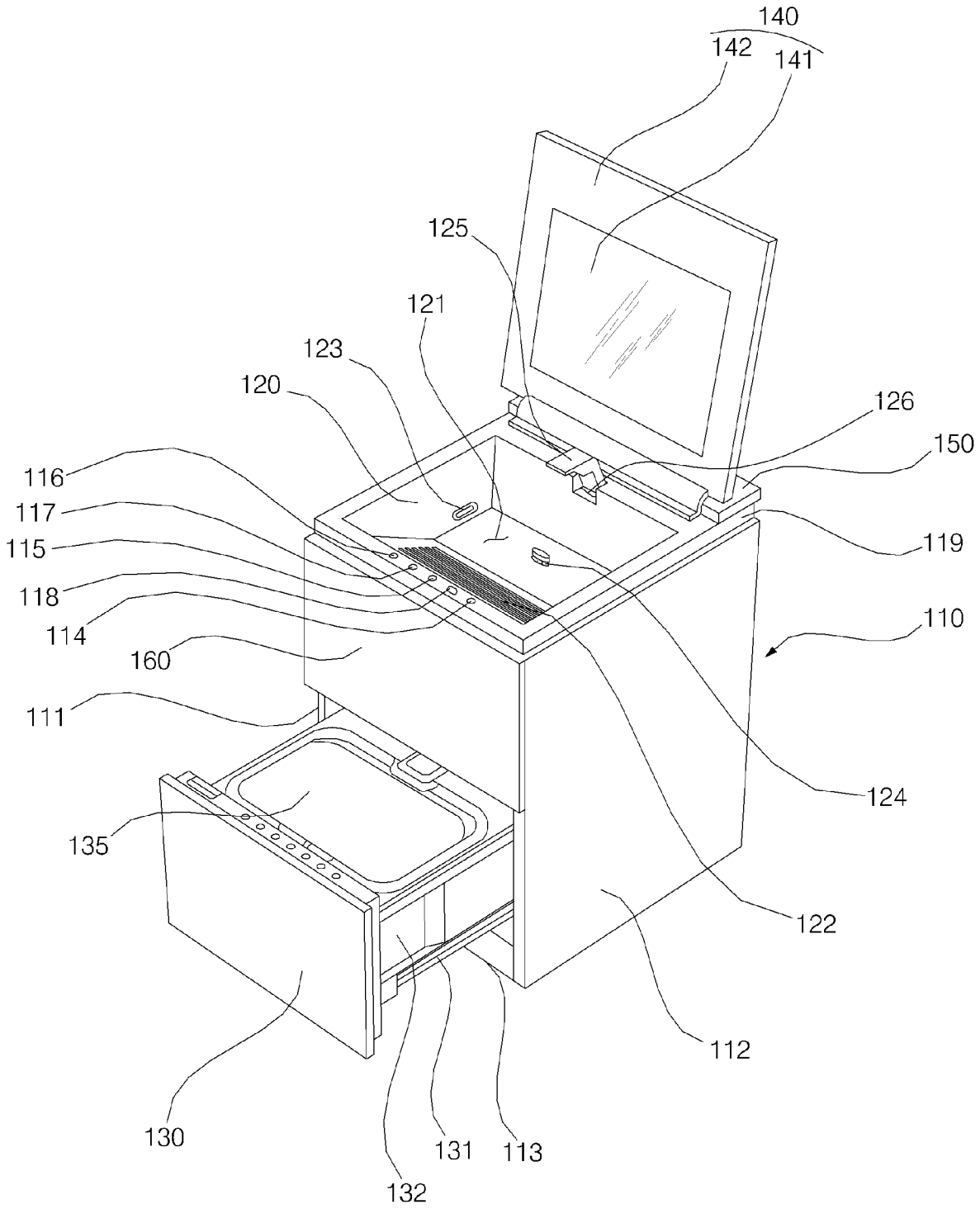
FIG. 3 is a view illustrating an example where a lid illustrated in FIG. 2 is opened and a drawer type washer illustrated in FIG. 2 is drawn out.

Referring to FIGS. 2 and 3, the pre-washer 100 may include a cabinet 110, a sink bowl 120, and a drawer type washer 130. The cabinet 110 is formed in a rectangular shape having a top surface and a front surface which are open, and a hollow inner space. That is, the cabinet 110 may include a left side panel 111, a right side panel 112, a back panel (not shown), a lower panel 113, and a top panel 119. Each of the left side panel 111, the right side panel 112, the back panel, the lower panel 113, and the top panel 119 may be formed in a rectangular shape. As used here, directions, such as "left", "right", "front", "back", top, and bottom, are relative to a user of the installed pre-washer 100.

The left side panel 111 may form a left surface of the cabinet 110. The right side panel 112 is spaced apart from the left side panel 111, may be provided facing the left side panel 111, and may be formed to have the same size as the size of the left side panel 111, thereby forming a right surface of the cabinet 110.

The lower panel 113 may form a lower surface of the cabinet 110. Legs (not shown) may protrude downward from the bottom of the lower panel 113. The legs may be located at each of the four corners of the lower panel 113, so that the cabinet 110 may be lifted from a ground surface. The height of the legs may be adjusted by a user to balance the cabinet 110.

The top panel 119 may form a top surface of the cabinet 110. The top panel 119 may have a middle hollow space, at which the sink bowl 120 may be provided. In the top panel 119, operation parts (or user interfaces) 114, 115, 116, and 117 and a display 118 may be provided forward of the sink bowl 120. The operation parts 114, 115, 116, and 117 may be mechanical buttons or touch buttons. In another example, the operation parts 114, 115, 116, and 117 may correspond to regions of a touch screen. The operation parts 114, 115, 116, and 117 may include a power operation part (or power user interface) 114, a wash cycle operation part (or wash cycle user interface) 115, and water supply operation parts (or water supply user interface) 116 and 117. The display 118 may display, for example, information regarding an operation state of the operation parts 114, 115, 116, and 117 and soaking time.

The sink bowl 120 may be provided at an open top surface of the cabinet 110. The sink bowl 120 may have an accommodation space 121 which is provided at an upper portion of the cabinet 110 and is formed in a rectangular shape. The accommodation space 121 may be formed by an open top portion of the sink bowl 120, and may accommodate laundry and wash water. A user may put the laundry and wash water into the accommodation space 121 at the top of the sink bowl 120. After the laundry and wash water are introduced into the accommodation space 121, pre-washing of the laundry may be performed.

The accommodation space 121 in the sink bowl 120 may have a front surface which is tilted such that a lower end of the front surface is closer to a rear side of the accommodation space 121 than an upper end of the of the front surface. A plurality of washing ribs 122 may protrude upward from the front surface of the accommodation space 121 of the sink bowl 120. The plurality of washing ribs 122 may be vertically spaced apart from each other, and may be formed to be horizontally elongated. A user may rub the laundry against the plurality of washing ribs 122 to pre-wash the laundry.

A water stream generator (or pump) 123 may be provided on both the left side and the right side of the accommodation space 121 of the sink bowl 120. Although FIG. 3 illustrates an example where the water stream generator 123 is provided only on the left side of the accommodation space 121 in the sink bowl 120, another water stream generator 123 may also be provided on the right side of the accommodation space 121 in the sink bowl 120 at a position corresponding the position of the left side water stream generator 123. However, a single water stream generator 123 may be provided on one of the left side, the right side, or other portion of the accommodating space 121 of the sink bowl 120.

The water stream generator 123 may generate water stream in wash water accommodated in the accommodation space 121. As the water stream generator 123 generates water stream in wash water accommodated in the accommodation space 121, there is no need for a user to perform pre-washing of the laundry by hand; and by simply positioning the laundry in the accommodation space 121, pre-washing and soaking of the laundry may be performed automatically by the water stream generated by the water stream generator 123. In one example, the water stream generator 123 may spray air onto the wash water accommodated in the accommodation space 121, to generate the water stream in the wash water accommodated in the accommodation space 121. In another example, the water stream generator 123 may include an impeller to generate the water stream in the wash water.

A drain hole 124, through which the wash water accommodated in the accommodation space 121 is drained, may be formed at the bottom surface of the sink bowl 120. As described herein, the drain hole may be selectively closed during pre-washing to maintain wash water in the accommodation space 121 and may be selectively opened after the pre-washing to remove the wash water.

A faucet 125, which supplies the wash water into the accommodation space 121, may be installed at the sink bowl 120. The faucet 125 is connected with a water supply pipe in a building, to supply the wash water into the accommodation space 121. The faucet 125 may be installed to be movable upward and downward at a rear side of the sink bowl 120. A faucet receiving groove 126 may be formed at a top rear side of the sink bowl 120. When the faucet 125 moves upward, the faucet 125 may be withdrawn from the faucet receiving groove 126 to protrude upward from the sink bowl 120. When the faucet 125 moves downward, the faucet 125 may be received in the faucet receiving groove 126. After receiving the faucet 125 in the faucet receiving groove 126, a user may close the lid 140 which will be described later. That is, when the lid 140 is closed, the faucet 125 may be received in the faucet receiving groove 126 and may be provided below the lid 140.

The lid 140, which opens and closes the open top of the accommodation space 121, may be provided at the top portion of the cabinet 110. The water stream generator 123 may generate the water stream in the wash water accommodated in the accommodation space 121. When the water stream generator 123 generates the water stream in the wash water accommodated in the accommodation space 121, a user may close the lid 140 so that during the pre-washing process, the wash water accommodated in the accommodation space 121 is not splashed out of the sink bowl 120.

The lid 140 may be formed in a rectangular shape. The lid 140 may include a lid glass 141, and a lid frame 142 supporting the lid glass 141 by surrounding the edges of the lid glass 142. The lid glass 141 may be formed in a rectangular shape, and the lid frame 142 may support the lid glass 141 by surrounding the four edges of the rectangular-shaped lid glass 141. The lid glass 141 may be made of a transparent material. While the lid 140 closes the open top surface of the accommodation space 121, a user may see the laundry accommodated in the accommodation space 121 through the lid glass 141 from above the lid glass 141.

A rear panel 150 may be provided at the top portion of the cabinet 110. The rear panel 150 may be provided rearward of the lid 140. The lid 140 may occupy most of the top surface of the cabinet 110, and the rear panel 150 may occupy a remaining portion behand the portion occupied by the lid 140. When the lid 140 closes the open top of the accommodation space 121, the top surface of the lid 140 and the top surface of the rear panel 150 may be substantially horizontal to each other. A rear end of the lid 140 may be rotatably connected to the rear panel 150. When the lid 140 is totally open, the rear surface of the lid 140 may come into contact with the top surface of the rear panel 150 to be supported thereby. In this manner, when the lid 140 is totally open, the lid 140 may be supported by the rear panel 150, thereby remaining open.

A drawer 160 may be provided at the open front surface of the cabinet 110. The drawer 160 may be provided below the sink bowl 120, and may move inwards and outwards of the cabinet 110. Left and right sides of the drawer 160 are connected to left and right interior sides of the cabinet 110 to be slidable forward and backward, such that the drawer 160 may move inwards and outwards of the cabinet 110. A washing detergent or other items may be held in the drawer 160.

The drawer type washer 130 may be provided at the open front surface of the cabinet 110. The drawer type washer 130 may be provided below the sink bowl 120. The drawer type washer 130 may be provided below the drawer 160. The drawer type washer 130 may move inwards and outwards of the cabinet 110. A rail 131 may be installed on left and right sides of the drawer type washer 130, and a rail guide (not shown), to which the rail 131 is connected to be slidable forward and backward, may be installed on left and right interior sides of the cabinet 110, such that the drawer type washer 130 may be move inwards and outwards of the cabinet 110. Although described as including the drawer type washer 130, the pre-washer 100 may include a different type of washing machine, such as a front loading washing machine that does not slide inward and outward from the cabinet 100 and includes a front door to providing an opening to receive the laundry from the sink bowl 120.

The drawer type washer 130 may have a structure of a general top-loading washing machine. The drawer type washer 130 may perform washing, rinsing, and spin-drying of the laundry. After pre-washing the laundry in the accommodation space 121 of the sink bowl 120, a user may insert the pre-washed laundry into the drawer type washer 130 for main washing.

Figure 4:
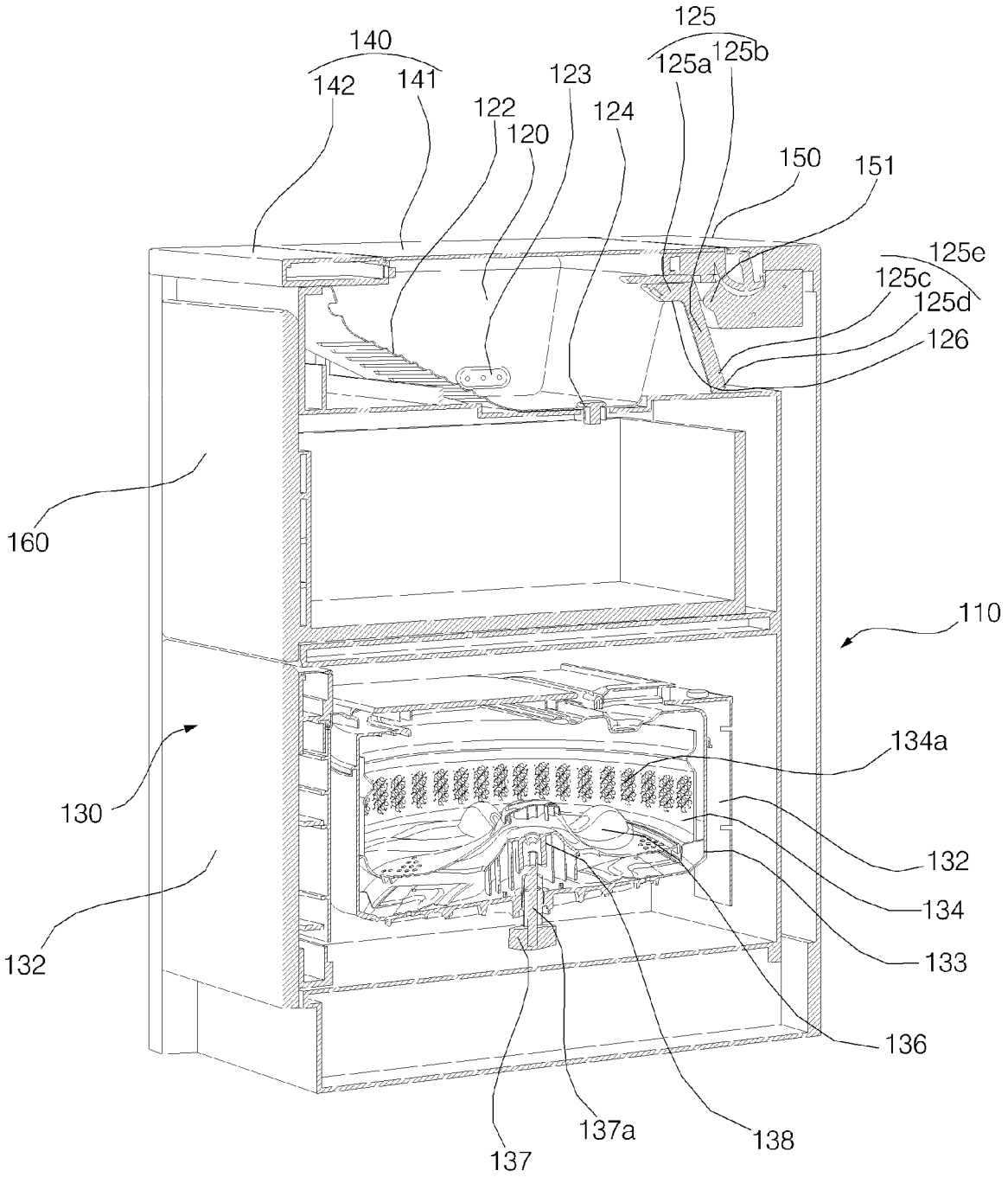
FIG. 4 is a side cross-sectional view of FIG. 2.

FIG. 4 is a side cross-sectional view of the pre-washer 100. Referring to FIGS. 3 and 4, the drawer type washer 130 may include a drawer frame 132, an outer chamber 133, and an inner chamber 134. The drawer frame 132 may form an external appearance of the drawer type washer 130. The drawer frame 132 may move forward and rearward in the cabinet 110. The rail 131 may be installed on left and right sides of the drawer frame 132 so that the drawer frame 132 may move forward and rearward in the cabinet 110. The drawer frame 132 has a cavity, and at least a portion of the drawer from 132 may be drawn in the cabinet 110, thereby providing a space to receive the outer chamber 133 and the inner chamber 134. The drawer frame 132 has an open top.

A door 135 may be provided at the open top of the drawer frame 132, to open and close the open top of the drawer frame 132. A display (not shown), which displays an operation state of the drawer type washer 130, and a user interface operation part (not shown) may be provided at the front top portion of the drawer frame 132.

The outer chamber 133 is provided in the cavity of the drawer frame 132 and may accommodate wash water. The outer chamber 133 may be formed in a cylindrical shape with an open top portion.

The inner chamber 134 is rotatably provided in the outer chamber 133, and may accommodate the laundry. The inner chamber 134 may be formed in a circle shape with an open top portion. A user may open the door 135 to insert the laundry through the open top of the drawer frame 132. The laundry inserted through the open top of the drawer frame 132 passes the open top portion of the outer chamber 133 to be accommodated in the inner chamber 134 through the open top portion of the inner chamber 134. A plurality of through-holes 134*a* may be formed on the circumferential surface of the inner chamber 134. The wash water accommodated in the outer chamber 133 may be introduced into the inner chamber 134 through the plurality of through-holes 134*a*.

A pulsator 136 may be rotatably provided on a bottom surface of the inner chamber 134. When the pulsator 136 rotates, a rotating water stream may be generated in the wash water in the inner chamber 134. A motor 137 may be provided in the drawer frame 132, and the motor 137 may be provided at a lower side of the outer chamber 133 in the drawer frame 132. A rotation axis 137*a* of the motor 137 may be vertically elongated. The rotation axis 137*a* of the motor 137 may vertically penetrate through the bottom surface of the outer chamber 133 and the bottom surface of the inner surface 134.

A clutch 138 may be interposed between the bottom surface of the outer chamber 133 and the pulsator 136. The clutch 138 may connect at least one of the inner chamber 134 or the pulsator 136 to the rotation axis 137*a* of the motor 137. When the clutch 138 connects the inner chamber 134 with the rotation axis 137*a* of the motor 137, the inner chamber 134 may rotate along with the rotation axis 137*a* of the motor 137. When the clutch 138 connects the pulsator 136 with the rotation axis 137*a* of the motor 137, the pulsator 136 may rotate along with the rotation axis 137*a* of the motor 137. When the clutch 138 connects both the inner chamber 134 and the pulsator 136 with the rotation axis 137*a* of the motor 137, the inner chamber 134 and the pulsator 136 may rotate along with the rotation axis 137*a* of the motor 137.

The faucet 125 may include a horizontal part (or horizontal arm) 125*a* received in the faucet receiving groove 126, and an extending part (or extending arm) 125*b* which extends downward from the horizontal part 125*a* to be provided rearward of the sink bowl 120. The faucet 125 may be installed at the sink bowl 120 to be movable upward and downward. When the faucet 125 moves upward, the horizontal part 125*a* may protrude outward from the faucet receiving groove 126, and when the faucet 125 moves downward, the horizontal part 125*a* may be received in the faucet receiving groove 126.

The extending part 125*b* is tilted with a lower end being closer to a rear side than an upper end. A latch groove 125*e* may be provided on a rear surface of the extending part 125*b*. Further, a latch protrusion 151, which is provided at the rear panel 150, may latch into the latch groove 125*e* when the faucet 125 protrudes from the faucet receiving groove 126. For example, when a user opens the lid 140, and then lifts up the horizontal part 125*a* of the faucet 125, the latch protrusion 151 may be latched into the latch groove 125*e*, such that the faucet 125 may remain protruding from the faucet receiving groove 126. Further, when the faucet 125 initially protrudes from the faucet receiving groove 126 and then a user presses down the horizontal part 125*a* of the faucet 125, the faucet 125 may move downward, and the latch protrusion 151 may be released from the latch groove 125*e*, such that the horizontal part 125*a* of the faucet 125 may be received in the faucet receiving groove 126. In one example, the latch protrusion 151 may be made of an elastic, deformable material to conform to the latch groove 125*e*.

The latch groove 125*e* may include a first latch groove 125*c*, and a second latch groove 125*d* which is provided below the first latch groove 125*c*. When the latch groove 125*e* includes the first latch groove 125*c* and the second latch groove 125*d*, a protruding height of the faucet 125, which protrudes upward from the sink bowl 120, may be adjusted.

Figure 5:
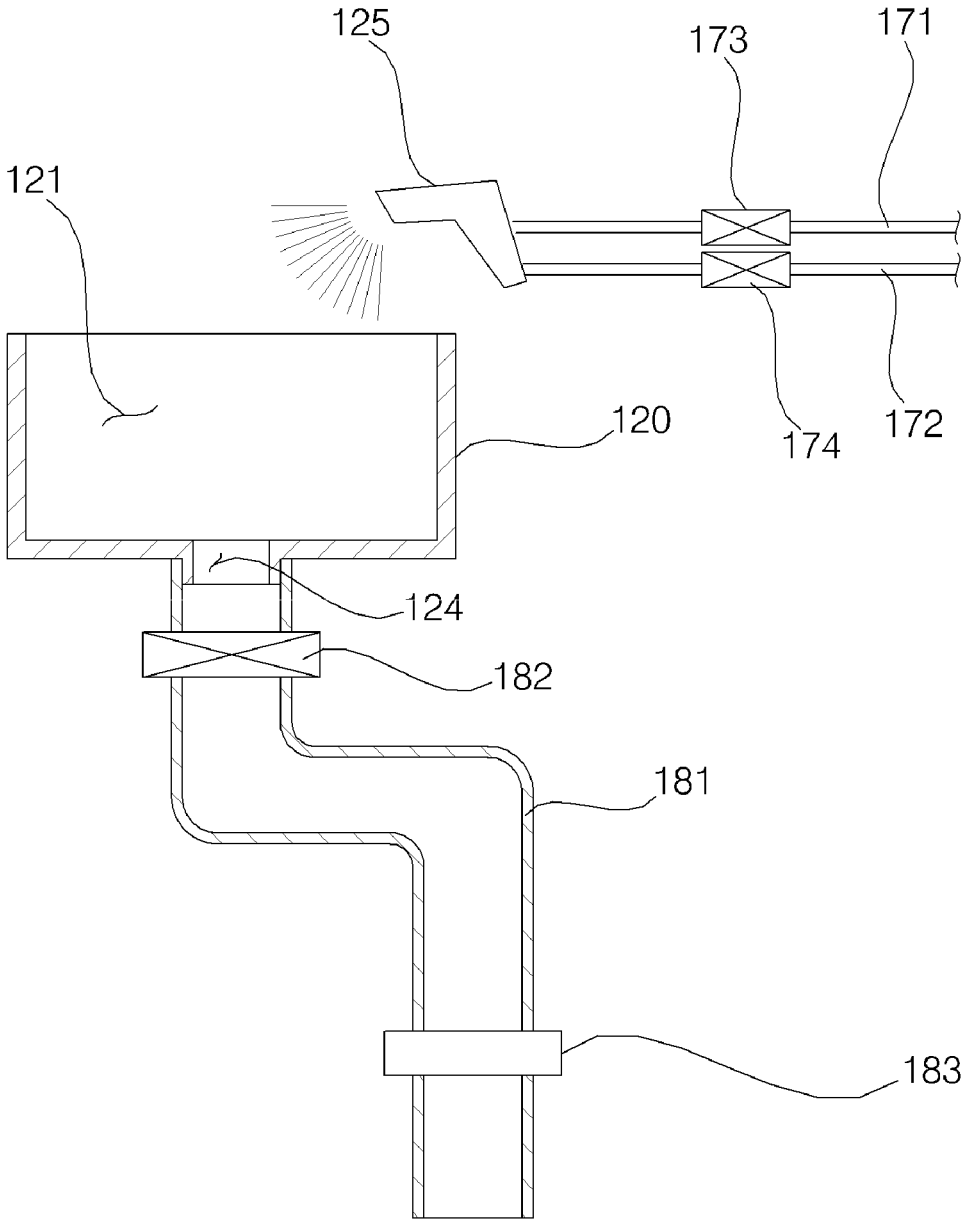
FIG. 5 is a partial view of a pre-washer.

FIG. 5 is a partial schematic view of the pre-washer 100. Referring to FIG. 5, the faucet 125 may be connected to the water supply passages 171 and 172. The water supply passages 171 and 172 may supply wash water to the faucet 125. The water supply values 173 and 174 may open and close the water supply passages 171 and 172. When the water supply valves 173 and 174 are open, the faucet 125 may supply the wash water, received from the water supply passages 171 and 172, to the accommodation space 121 of the sink bowl 120.

The water supply passages 171 and 172 may include a cold water passage 171 and a hot water passage 172. The cold water passage 171 may supply cold water (e.g., water at ambient temperature) to the faucet 125, and the hot water passage 172 may supply hot water (e.g., water warmed above ambient temperature) to the faucet 125.

The water supply valves 173 and 174 may include a cold water valve 173 and a hot water valve 174. The cold water valve 173 may be installed at the cold water passage 171, and the hot water valve 174 may be installed at the hot water passage 172. The cold water valve 173 may open and close the cold water passage 171, and the hot water valve 174 may open and close the hot water passage 172. When the cold water valve 173 is opened, the faucet 125 may supply cold water, supplied from the cold water passage 171, to the accommodation space 121 of the sink bowl 120. When the hot water valve 174 is opened, the faucet 125 may supply hot water, supplied from the hot water passage 172, to the accommodation space 121 of the sink bowl 120.

The sink bowl 120 may be connected to a drain passage 181. The drain passage 181 may drain wash water in the accommodation space 121 of the sink bowl 120. The drain passage 181 may be located at a position corresponding to the drain hole 124 from below the bottom of the sink bowl 120. The drain passage 181 may be provided with a drain valve 182. The drain valve 182 may selectively open and close the drain passage 181. When the drain valve 182 is opened, wash water in the accommodation space 121 of the sink bowl 120 may be drained to the outside through the drain passage 181. The drain passage 181 may further include a drain pump 183. The drain pump 183 may be activated to suction the wash water in the drain passage 181 and direct the water to the outside. The drain pump 183 may selectively operate while the drain valve 182 is opened to suction the wash water in the drain passage 181 to drain the wash water to the outside.

Figure 6:
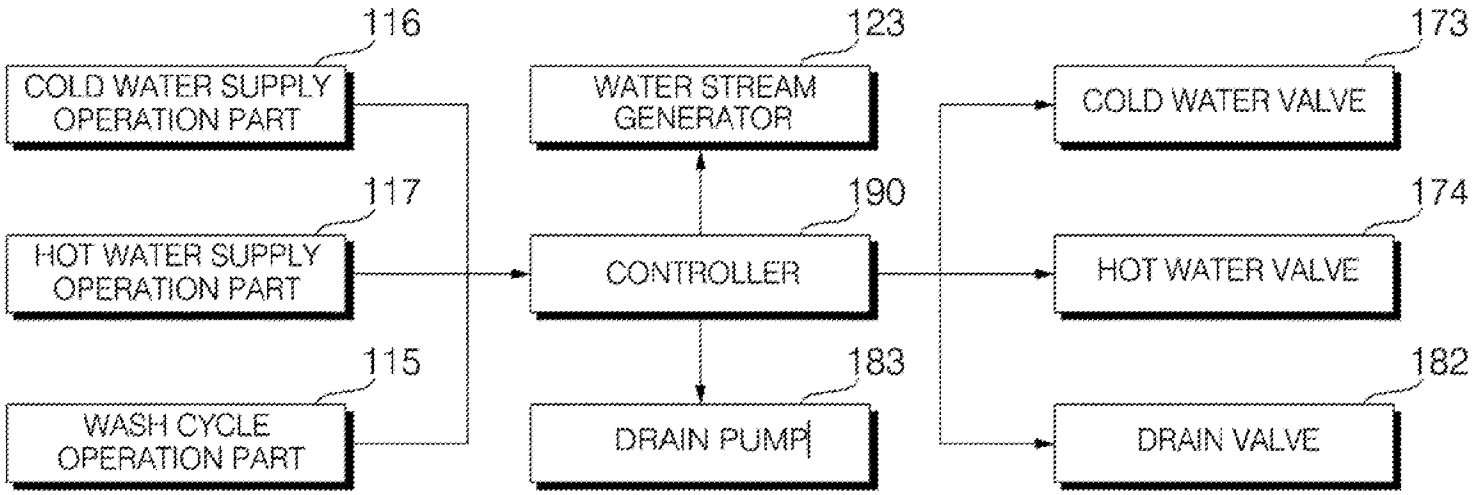
FIG. 6 is a control block diagram illustrating a pre-washer.

FIG. 6 is a control block diagram illustrating components of the pre-washer 100. Referring to FIG. 6, the pre-washer 100 may further include a controller 190. Once a water supply signal is received from water supply operation parts 116 and 117, the controller 190 may open the water supply valves 173 and 174.

As previously described, the water supply operation parts 116 and 117 may be mechanical buttons or touch buttons. For example, when pressed or touched once by a user (or other specific user input is provided), the water supply operation parts 116 and 117 may generate the water supply signal, and the generated water supply signal may be inputted to the controller 190. Further, when being pressed or touched once again by a user (or other specific user input is provided), the water supply operation parts 116 and 117 may generate a water cut-off signal, and the generated water cut-off signal may be input to the controller 190. Upon receiving the water supply signal from the water supply operation parts 116 and 117, the controller 190 opens one or more of the water supply valves 173 and 174, and upon receiving the water cut-off signal from the water supply operation parts 116 and 117, the controller 190 closes the opened one or more of the water supply valves 173 and 174. When one or more of the water supply valves 173 and 174 are opened, the faucet 125 may supply wash water to the accommodation space 121 of the sink bowl 120, and when the opened one or more of the water supply valves 173 and 174 are closed, the faucet 125 may cut off a supply of the wash water to the accommodation space 121 of the sink bowl 120.

The water supply operation parts 116 and 117 may include, for example, a cold water supply operation part 116 and a hot water supply operation part 117. When being pressed or touched once by a user (or other particular user input is detected), the cold water supply operation part 116 generates a cold water supply signal, and the generated cold water supply signal is input to the controller 190. Upon receiving the cold water supply signal from the cold water operation part 116, the controller 190 opens the cold water valve 173, to allow the faucet 125 to supply cold water to the accommodation space 121 of the sink bowl 120. When being pressed or touched once again by a user (or other particular user input is detected), the cold water supply operation part 116 generates a cold water cut-off signal, and the generated cold water cut-off signal is input to the controller 190. Upon receiving the cold water cut-off signal from the cold water supply operation part 116, the controller 190 closes the cold water valve 173, so as to stop the faucet 125 from supplying cold water to the accommodation space 121 of the sink bowl 120.

Further, when being pressed or touched once by a user (or other particular user input is detected), the hot water supply operation part 117 generates a hot water supply signal, and the generated hot water supply signal is inputted to the controller 190. Upon receiving the hot water supply signal from the hot water supply operation part 117, the controller 190 opens the hot water valve 174 to allow the faucet 125 to supply hot water to the accommodation space 121 of the sink bowl 120. When being pressed or touched once again by a user (or other particular user input is detected), the hot water supply operation part 117 generates a hot water cut-off signal, and the generated hot water cut-off signal is inputted to the controller 190. Upon receiving the hot water cut-off signal from the hot water supply operation part 117, the controller 190 closes the hot water valve 174 so as to stop the faucet 125 from supplying hot water to the accommodation space 121 of the sink bowl 120.

Upon receiving a wash cycle signal from the wash cycle operation part 115, the controller 190 operates the water stream generator 123 for a predetermined period of time, and after the predetermined period of time, stops the water stream generator 123 and opens the drain valve 182. Accordingly, decoloring and damage of the laundry, which is caused by excessive pre-washing and soaking of the laundry, may be prevented. When the drain passage 181 includes both the drain valve 182 and the drain pump 183, upon receiving a wash cycle signal from the wash cycle operation part 115, the controller 190 operates the water stream generator 123 for a predetermined period of time, and after the predetermined period of time, stops the water stream generator 123 to open the drain valve 182 and operate the drain pump 183 to drain the wash water.

The wash cycle operation part 115 may be a mechanical button or a touch button. The wash cycle signal may include a first wash cycle signal and a second wash cycle signal. That is, when pressed or touched once by a user (or other particular user input is detected), the wash cycle operation part 115 may generate the first wash cycle signal, and the generated first wash cycle signal may be input to the controller 190. When pressed or touched once again by a user (or other particular user input is detected), the washing cycle operation part 115 may generate the second wash cycle signal, and the generated second wash cycle signal may be input to the controller 190.

Upon receiving the first wash cycle signal from the wash cycle operation part 115, the controller 190 operates the water stream generator 123 for a first predetermined period of time, and after the first period of time, stops the water stream generator 123 and opens the drain valve 182 to remove the wash water. When the drain passage 181 includes the drain valve 182 and the drain pump 183, upon receiving the first wash cycle signal from the wash cycle operation part 115, the controller 190 operates the water stream generator 123 for the first predetermined period of time, and after the first period of time, stops the water stream generator 123, to open the drain valve 182 and operate the drain pump 183 to drain the wash water.

Further, upon receiving the second wash cycle signal from the wash cycle operation part 115, the controller 190 operates the water stream generator 123 for a second predetermined period of time, and after the second period of time the water stream generator 123 and opens the drain valve 182 to remove the wash water. When the drain passage 181 includes the drain valve 182 and the drain pump 183, upon receiving the second wash cycle signal from the wash cycle operation part 115, the controller 190 operates the water stream generator 123 for the second predetermined period of time, and after the second period of time, stops the water stream generator 123, opens the drain valve 182, and operates the drain pump 183.

The second predetermined period of time may be different from, and may be shorter than, the first predetermined period of time. When wash water, which is accommodated in the accommodation space 121 of the sink bowl 120, is cold water, a user may operate the wash cycle operation part 115 to generate the first wash cycle signal. Further, when the wash water, which is accommodated in the accommodation space 121, is hot water, a user may operate the wash cycle operation part 115 to generate the second wash cycle signal.

Figure 7:
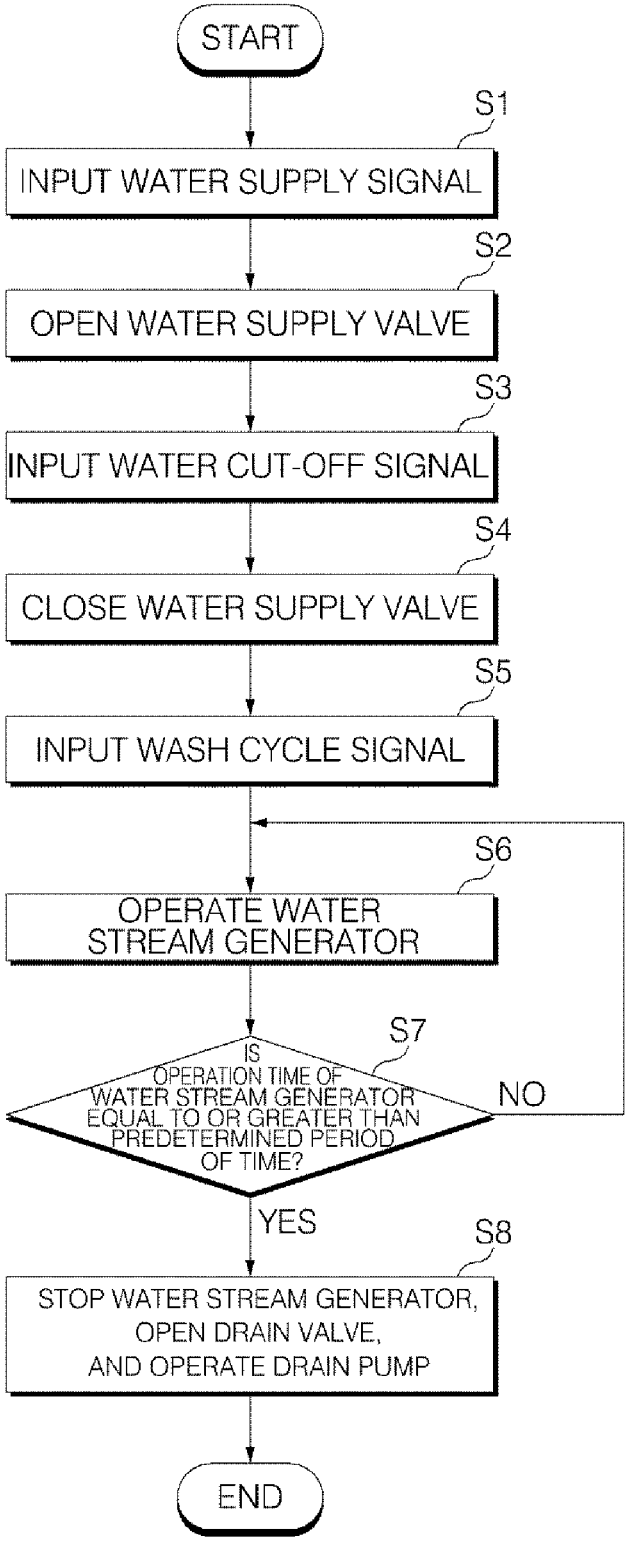
FIG. 7 is a flowchart illustrating a method of controlling a pre-washer.

FIG. 7 is a flowchart illustrating a method of controlling a pre-washer. Here, the method of controlling the pre-washer will be described in connection with the operation of the pre-washer. Referring to FIG. 7, upon opening the lid 140 and putting the laundry into the accommodation space 121 of the sink bowl 120, a user may operate the water supply operation units 116 and 117 to generate a water supply signal. Then, the water supply signal generated by the water supply operation units 116 and 117 is inputted to the controller 190 in S1. When the user opens the lid 140, inserts the laundry into the accommodation space 121 of the sink bowl 120, and operates the cold water operation part 116, a cold water signal is generated, and the cold water signal generated by the cold water operation part 116 is inputted to the controller 190. Further, when the user opens the lid 140, inserts the laundry into the accommodation space 121 of the sink bowl 120, and operates the hot water operation part 117, a hot water signal is generated, and the hot water signal generated by the hot water operation part 116 is inputted to the controller 190.

Upon receiving the water supply signal from the water supply operation parts 116 and 117, the controller 190 opens the water supply valves 173 and 174 in S2. For example, upon receiving the cold water signal from the cold water operation part 116, the controller 190 opens the cold water valve 173, and upon receiving the hot water signal from the hot water operation part 117, the controller 190 opens the hot water valve 174.

Once wash water is filled to a desired level in the accommodation space 121 of the sink bowl 120, a user may operate the water supply operation parts 116 and 117 again to generate a water cut-off signal. Then, the water cut-off signal generated by the water supply operation parts 116 and 117 is input to the controller 190 in S3. In another example, the water cut-off signal is automatically sent after a prescribed time period or after a prescribed amount of wash water is supplied to the accommodation space 121.

Upon receiving the water cut-off signal from the water supply operation parts 116 and 117, the controller 190 closes the water supply valves 173 and 174 in S4. Then, a user operates the wash cycle operation part 115 to generate a wash cycle signal, and may further close the lid 140. Then, the wash cycle signal generated by the wash cycle operation part 115 is input to the controller 190 in S5. Upon receiving the wash cycle signal from the wash cycle operation part 115, the controller 190 activates the water stream generator 123 in S6 to form a water stream in the wash water to pre-wash the laundry.

Then, the controller 190 determines whether the operation time of the water stream generator 123 is equal to or greater than a predetermined period of time in S7. When the operation time of the water stream generator 123 is less than the predetermined period of time, the controller 190 continues to operate the water stream generator 123 in S6. When the operation time of the water stream generator 123 is greater than the predetermined period of time, the controller 190 stops the water stream generator 123, opens the drain valve 182, and operates the drain pump 183 in S8 to remove the wash water from the accommodation space 121.

Figure 8:
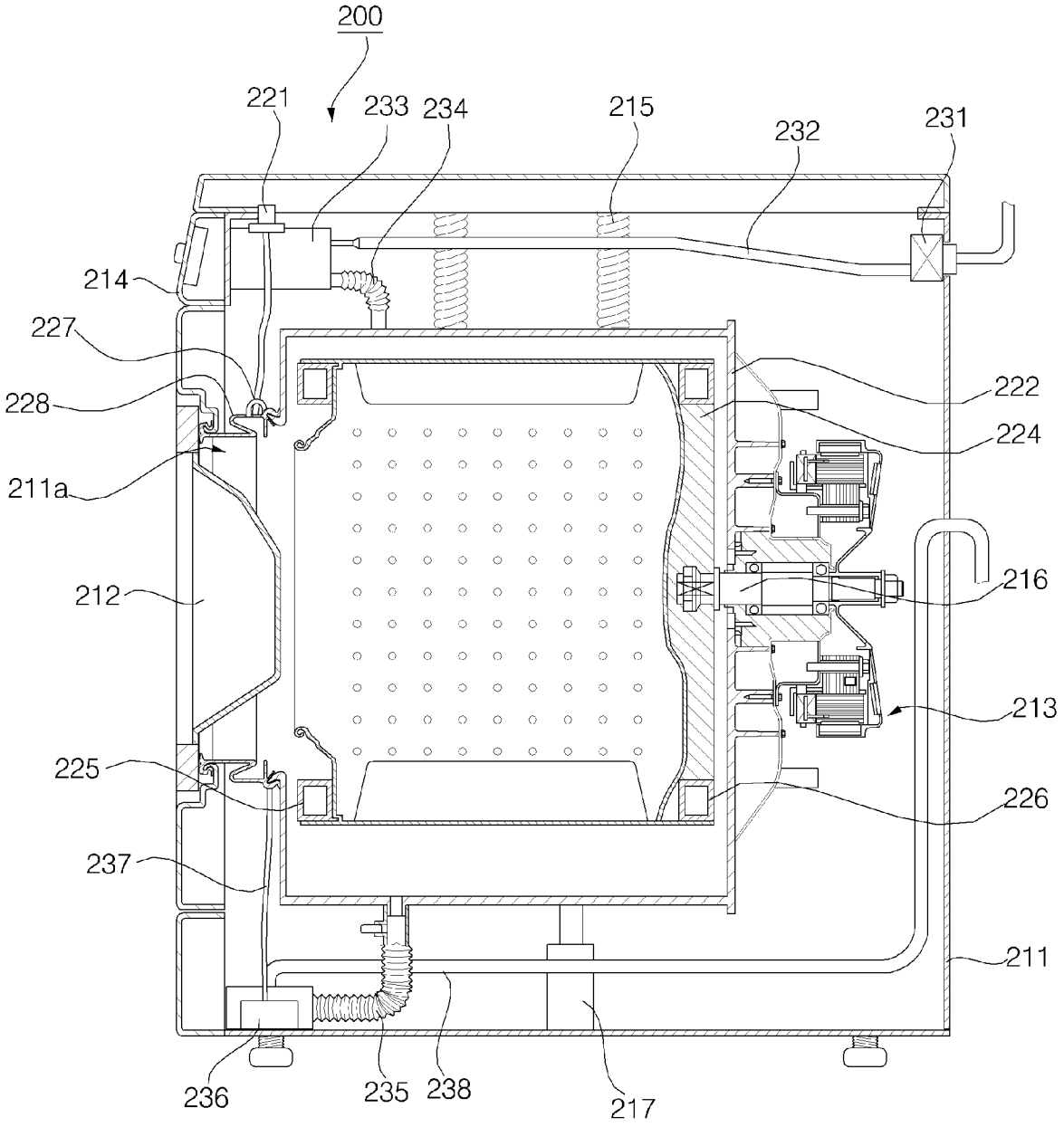
FIG. 8 is a cross-sectional view of a main washer illustrated in FIG. 1.
Figure 9:
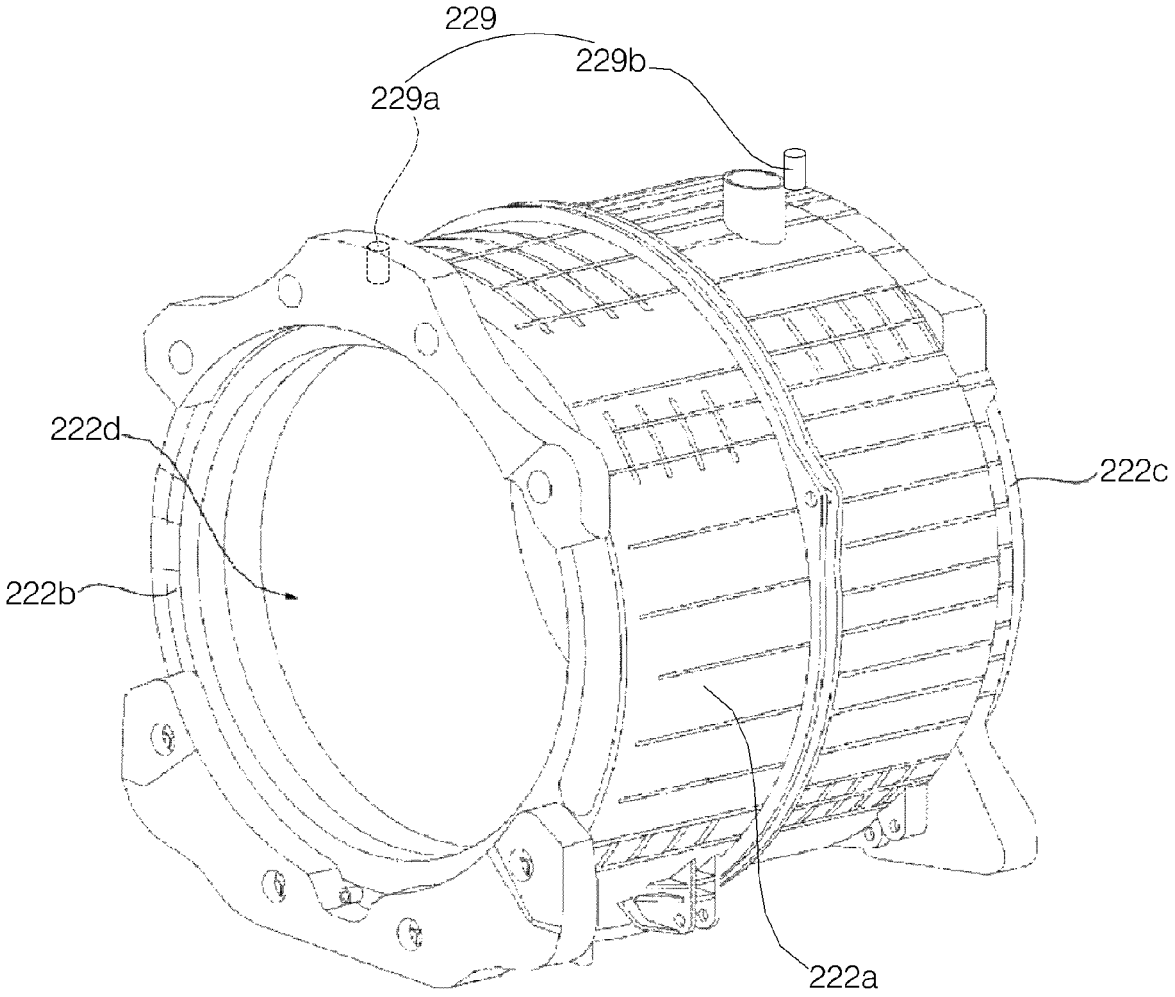
FIG. 9 is a perspective view of a drum of the main washer illustrated in FIG. 8.

The main washer 200 will be described below. FIG. 8 is a cross-sectional view of a main washer illustrated 200; FIG. 9 is a perspective view of a drum 224 of the main washer 200; and FIG. 10 is a perspective view of a tub 222 of the main washer 200.

Figure 10:
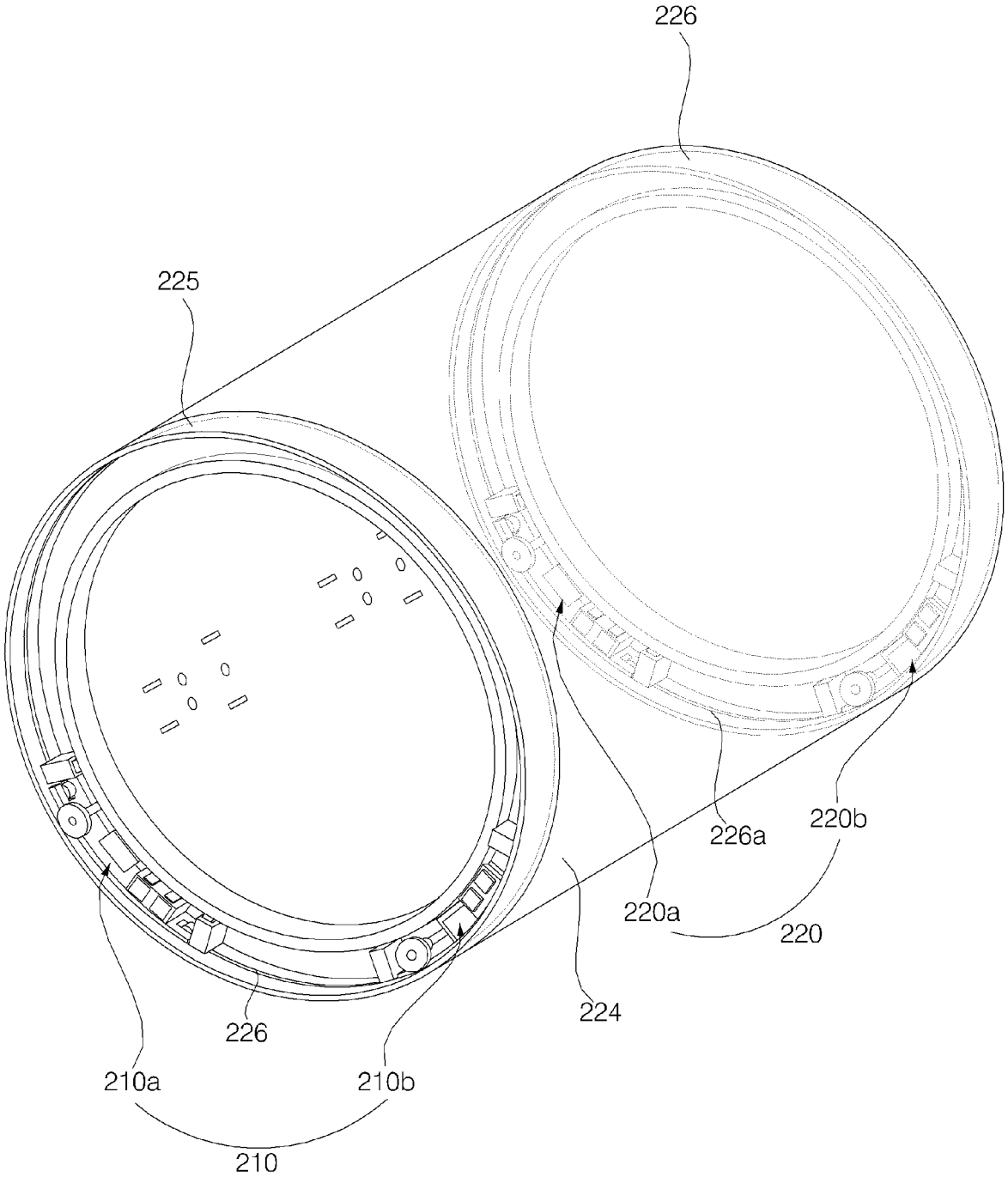
FIG. 10 is a perspective view of a tub of the main washer illustrated in FIG. 8.

Referring to FIGS. 8 to 10, the main washer 200 may include a cabinet 211 which forms an external appearance of the main washer; a door 212 which opens and closes one side of the cabinet 211 so that laundry may be put into the cabinet 211; a tub 222 which is provided in the cabinet 211 and is supported by the cabinet 211; a drum 224 which is provided in the tub 222 and rotates when the laundry is put; a drum motor 213 which provides torque to the drum 224 to rotate the drum 224; a detergent box 233 in which detergent is held; a control panel 214 which receives a user's input and displays status of a washing machine.

The cabinet 211 includes a laundry inlet hole 211*a*, through which laundry is put into the cabinet 211. The door 212 is rotatably connected with the cabinet 211 to open and close the laundry inlet hole 211*a*. The cabinet 211 is provided with the control panel 214. The cabinet 211 is provided with the detergent box 233, which is retractable.

A spring 215 and a damper 217 are provided in the cabinet 211 to absorb shock of a movement of the tub 222 during operation of the washer 200. The tub 222 contains the wash water. The tub 222 is provided outside the drum 224 to surround the drum 224.

The tub 222 include: a tub main body 222*a* which has a cylindrical shape and both ends of which are open; a front tub cover 222*b* which has a ring shape and is provided at a front side of the tub main body 222*a*; a rear tub cover 222*c* which has a disc shape and is provided at a rear side of the tub main body 222*a*. Hereinafter, the front side refers to the side of the door 212, and the rear side refers to the side of the drum motor 213. A tub hole 222*d* is formed at the front tub cover 222*b*. The tub hole 222*d* is formed to communicate with the laundry inlet 211*a* so that the laundry may be put into the drum 224.

The drum motor 213 is provided at the rear tub cover 222*c* to generate torque. The drum motor 213 is connected with a rotation axis 216 to rotate the drum 224. The drum motor 213 may rotate the drum 224 at various speeds and directions. The drum motor 213 typically includes: a stator (not shown) wound with a coil; and a rotor (not shown) which rotates by generating electromagnetic interaction with the coil.

The rotation axis 216 connects the drum motor 213 with the drum 224. The rotation axis 216 transfers torque to the drum 244 to rotate the drum 224. One end of the rotation axis 216 is connected to the center of rotation at the rear side of the drum 224, and the other end of the rotation axis 216 is connected with the rotor (not shown) of the drum motor 213.

Laundry is received in the drum 224, and the drum 224 rotates within the tub 222 to move the laundry relative to the wash water. The drum 224 is provided in the tub 222. The drum 224 is formed in a cylindrical shape and is rotatable. The drum 224 has a plurality of through-holes through which wash water may pass. The drum 224 rotates by receiving the torque from the drum motor 213.

A drum hole 224*a* is provided at a front side of the drum 224. The drum hole 224*a* is formed to communicate with the laundry inlet hole 211*a* and the tub hole 222*d* to provide a passage through which the laundry is inserted into the drum 224. A front guide rail 225 is connected to a front circumference of the drum 224, and a rear guide rail 226 is connected to a rear circumference of the drum 224.

A gasket 228 seals a space between the tub 222 and the cabinet 211. The gasket 228 may be interposed between the opening of the tub 222 and the laundry inlet hole 211*a*. The gasket 228 absorbs shock delivered to the door 212 when the drum 224 rotates, and prevents wash water in the tub 222 from leaking to the outside. The gasket 228 may be provided with a circulation nozzle 227 which sprays wash water into the drum 224.

The detergent box 233 may hold a detergent, a fabric softener, bleach, and the like. The detergent box 233 is retractable at the front surface of the cabinet 211. When wash water is supplied, the detergent in the detergent box 233 is mixed with the wash water to be introduced into the tub 222.

The cabinet 211 may include a water supply valve 231 which adjusts introduction of the wash water supplied from an external water source. The cabinet 211 may also include a water supply passage 232 through which the wash water, introduced into the water supply valve, flows to the detergent box 233, and a water supply pipe 234 through which the wash water, mixed with the detergent in the detergent box 233, is introduced into the tub 222.

The cabinet 211 may further includes a drain pipe 235 through which the wash water in the tub 222 is drained; a pump 236 which discharges the wash water in the tub 222, and a circulation passage 237 which circulates the wash water. The cabinet 211 may also include a circulation nozzle 227 which introduces the wash water is into the drum 224; and a drain passage 238 through which the wash water is drained to the outside. Depending on embodiments, the pump 236 may include a circulation pump and separate a drain pump which may be connected to the circulation passage 237 and the drain passage 238 respectively.

The drain pipe 235 may be include a water level sensor 221 which senses the level of wash water contained in the tub 222. The water level sensor 221 may be implemented in various manners. In the embodiment, the level of water is measured by changing a space between electrodes by using air pressure changed according to the level of wash water, and by using a change in capacitance of the electrodes.

A plurality of front balancing units (or front weights) 210 move along the front guide rail 225 of the drum 224, and a plurality of rear balancing units (or rear weights) 220 move along the rear guide rail 226 of the drum 224, so as to change the center of gravity of the drum 224. In this case, the center of gravity of the drum 224 does not refer to the center of mass of the drum 224 itself, but refers to a common center of gravity of objects, including the drum 224, the laundry which is put in the drum 224, the front guide rail 225, the rear guide rail 226, the plurality of front balancing units 210, the plurality of rear balancing units 220, and other elements attached to the drum 224, which rotate along with the drum 224 when the drum 224 rotates.

The plurality of front balancing units 210 move along a circumference at a front side of the drum 224, and the plurality of rear balancing units 220 move along a circumference at a rear side of the drum 224, thereby adjusting the center of gravity of the drum 224 when laundry leans to one side. When the drum 225 rotates with the laundry accumulated at one side, vibration and noise may be caused by this imbalance in which a geometrical center of the rotation axis 216 (the center of gravity) of the drum 224 does not coincide with a real center of gravity of the drum 224 due to the location of the laundry. The plurality of front balancing units 210 and the plurality of rear balancing units 220 cause the center of gravity of the drum 224 to be close to the rotation axis 216, to reduce the imbalance of the drum 224. In one embodiment, the plurality of front balancing units 210 correspond to two units of a first front balancing unit 210*a* and a second front balancing unit 210*b*; and the plurality of rear balancing units 220 correspond to two units of a first rear balancing unit 220*a* and a second rear balancing unit 220*b*.

The plurality of front balancing units 210 move actively along the front guide rail 225, and the plurality of rear balancing units 220 move actively along the rear guide rail 226. The active movement refers to movement of the plurality of front balancing units 210 or the plurality of rear balancing units 220 along the front guide rail 225 or the rear guide rail 226 by using their own power. For example, the front balancing units 210 may slide along the front guide rail 225, and the plurality of rear balancing units 220 may slide along the rear guide rail 226.

The front guide rail 225 is a passage where the plurality of front balancing units 210 move, and the rear guide rail 226 is a passage where the plurality of rear balancing units 220 move. The front guide rail 225 is formed in a ring shape and is connected to a front end circumference of the drum 224, and the rear guiderail 226 is formed in a ring shape and is connected to a rear end circumference of the drum 224. The front guide rail 225 and the rear guide rail 226 each may have protrusions so that the plurality of front balancing units 210 and the plurality of rear balancing units 220 may not be separated therefrom. The front guide rail 225 is provided with a front guide rail wire 225*a* to supply power to the plurality of front balancing units 210, and the rear guiderail 226 is provided with a rear guide rail wire 226*a* to supply power to the plurality of rear balancing units 220. The front guide rail wire 225*a* and the rear guide rail wire 226*a* are connected to power supplied from an external source.

The tub 222 is provided with a plurality of vibration sensors 229 to sense a vibration amount of the tub 222. The vibration caused by the imbalance of the drum 224 is transmitted by the rotation axis 216 to the tub 222, causing vibration of the tub 222. The plurality of vibration sensors 229 may sense the amount of the vibration to measure a degree of imbalance of the drum 224.

The plurality of vibration sensors 229 may be implemented by various sensors which sense the vibration amount of the tub 222. In one embodiment, the plurality of vibration sensors 229 may include a light sensor which is provided in the tub main body 222*a* and measures a distance between the tub 222 and the cabinet 211. In the embodiment, the plurality of vibration sensors 229 sense the vibration amount by using a change of distance between the cabinet 211 and the tub 222. In one configuration (see FIG. 9), the plurality of vibration sensors 229 may include a front vibration sensor 229*a* which is provided at a front side of the tub main body 222*a* and measures a front vibration amount corresponding to an amount of vibration at the front side of the tub 222; and a rear vibration sensor 229*b* which is provided at a rear side of the tub main body 222*a* and measures a rear vibration amount corresponding to the amount of vibration at the rear side of the tub 222.

The control panel 214 may include: an input part (not shown), which receives input of wash cycles selected by a user, or input of various operation commands such as operation time and reservation of wash cycles, and the like; and a display (not shown) which displays operation state of the main washer 200.

Figure 11:
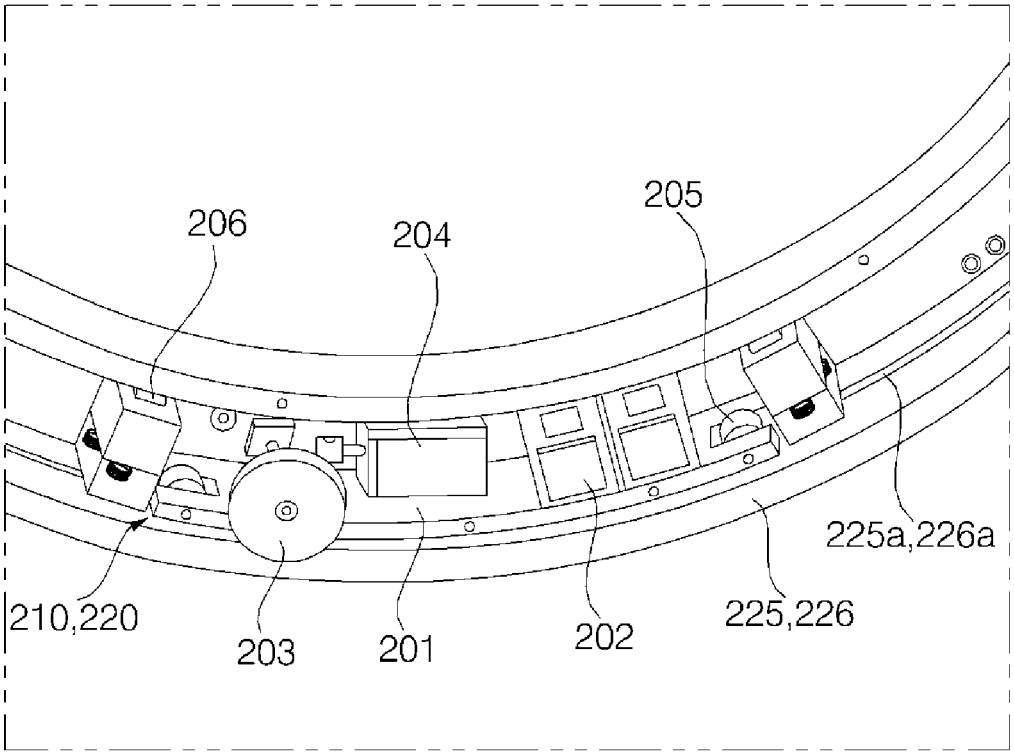
FIG. 11 is a perspective view of a balancing unit according to an embodiment of the present disclosure.

FIG. 11 is a perspective view of a balancing unit according to an embodiment of the present disclosure. Referring to FIG. 11, the plurality of front balancing units 210 and the plurality of rear balancing units 220 may each include a frame body 201, a body 202, a wheel 203, a motor 204, a contact terminal 205, and a brake 206.

The frame body 201 forms the frame of each of the plurality of front balancing units 210 and the plurality of rear balancing units 220, and the wheel 203, the body 202, the motor 204, and the like are connected thereto. The frame body 201 may be formed in a desired shape according to the shape of the front guide rail 225 or the rear guide rail 226.

The body 202 may have a weight suitable to serve as a mass body. According to certain embodiments, the wheel 203 rolls along the front guide rail 225 or the rear guide rail 226 so that the plurality of front balancing units and the plurality of rear balancing units 220 may move relatively smoothly. The wheel 203 may be made of a material having a large frictional force, such as a rubber, so that the wheel 203 may not slide from the front guide rail 225 or the rear guide rail 226. The wheel 203 rotates by the motor 204. Depending on embodiments, the wheel 203 may be replaced with a gear, such as a pinion gear or a worm gear. Further, when the wheel 203 is replaced with a gear, the front guide rail 225 or the rear guide rail 226 may include a rack gear or a worm wheel.

The motor 204 rotates the wheel 203. The motor 204 is supplied with power from the contact terminal 205 to generate torque. The contact terminal 205 contacts the front guide rail wire 225*a* or the rear guide rail wire 226*a* to transmit power supplied from an external force to the motor 204. In one example, the contact terminal 205 is made of a metal material having a small frictional force, so that the contact terminal 205 remains in contact with the front guide rail wire 225*a* or the rear guide rail wire 226*a* without loss of power.

The brake 206 allows each of the plurality of front balancing units 210 and the plurality of rear balancing units 220 to halt at a certain position of the guide rail 225. As the front guide rail 225 or the rear guide rail 226 rotates along with the drum 224, the brake 206 operate in order to prevent free rotation of each of the plurality of front balancing units 201 and the plurality of rear balancing units 220. The brake 206 applies a frictional force to the front guide rail 225 or the rear guide rail 226 to fix the plurality of front balancing units 210 and the plurality of rear balancing units 220 to the front guide rail 225 or the rear guide rail 226 respectively. As described herein, the brake 206 applies the frictional force to the front guide rail 225 or the rear guide rail 226 to fix the plurality of front balancing units 210 and the plurality of rear balancing units 220 at positioned to counter a detected imbalance.

Figure 12:
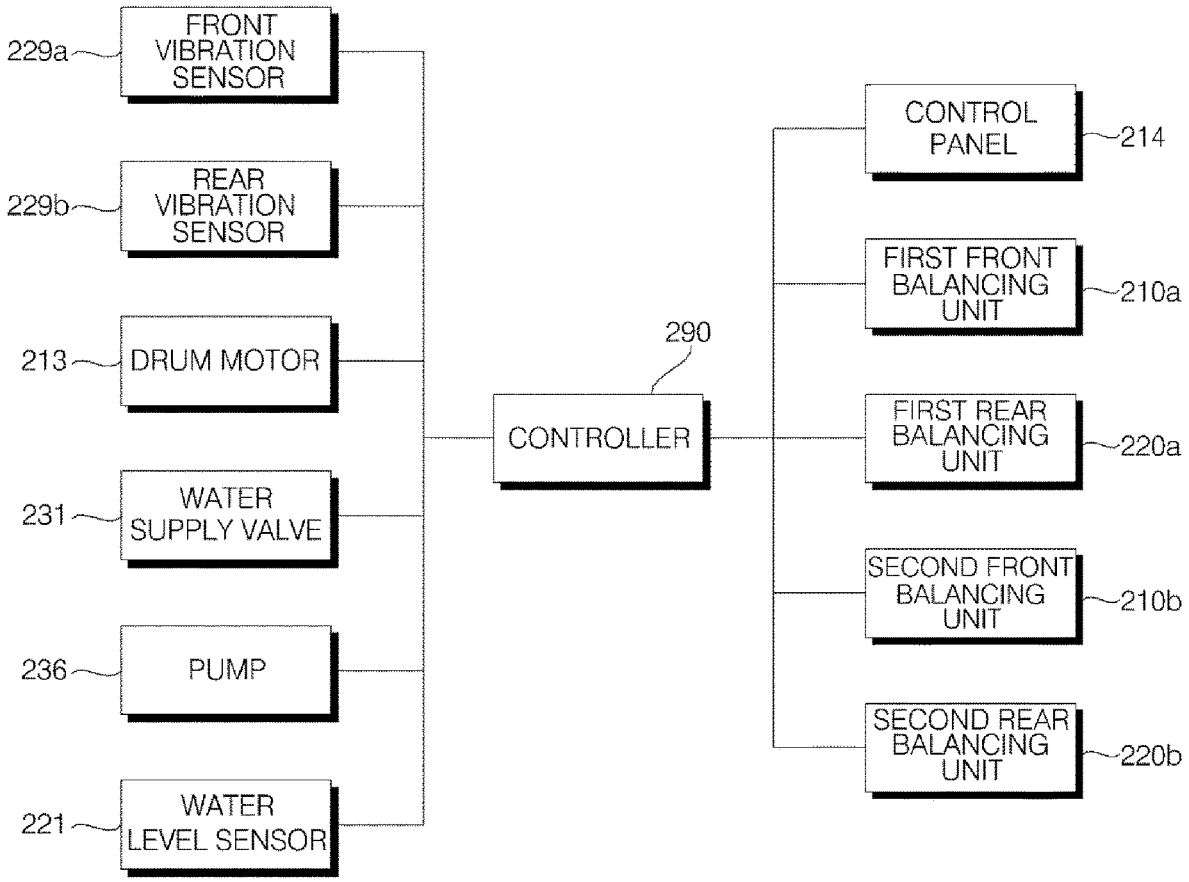
FIG. 12 is block diagram illustrating a main washer according to an embodiment of the present disclosure.

FIG. 12 is block diagram of the main washer 200 according to an embodiment of the present disclosure. Referring to FIG. 12, a controller 290 controls an overall operation of the main washer 200 according to operation commands received by the control panel 214. The controller 290 may include a microcomputer, a storage device, and other electronic components which control the operation of the main washer 200. According to wash cycles selected by a user, the controller 290 controls the water supply valve 231, the drum motor 213, and the pump 236 by determining whether to perform each cycle or whether to perform operations of water supply, washing, rinsing, drainage, spin-drying, drying, and the like in each cycle, operation time, the number of repeating operations, and the like. Based on the amount of laundry which is the weight of laundry measured at the initial stage of washing, and the water level of the tub 222 that is measured by the water level sensor 221, the controller 290 controls the water supply valve 231, the drum motor 213, and the pump 236. Additionally, based on the vibration amount of the tub 222 that is measured by the front vibration sensor 229*a* and the rear vibration sensor 229*b*, the controller 290 controls the first front balancing unit 210*a*, the second front balancing unit 210*b*, the first rear balancing unit 220*a* and the second rear balancing unit 220*b*.

Figure 13:
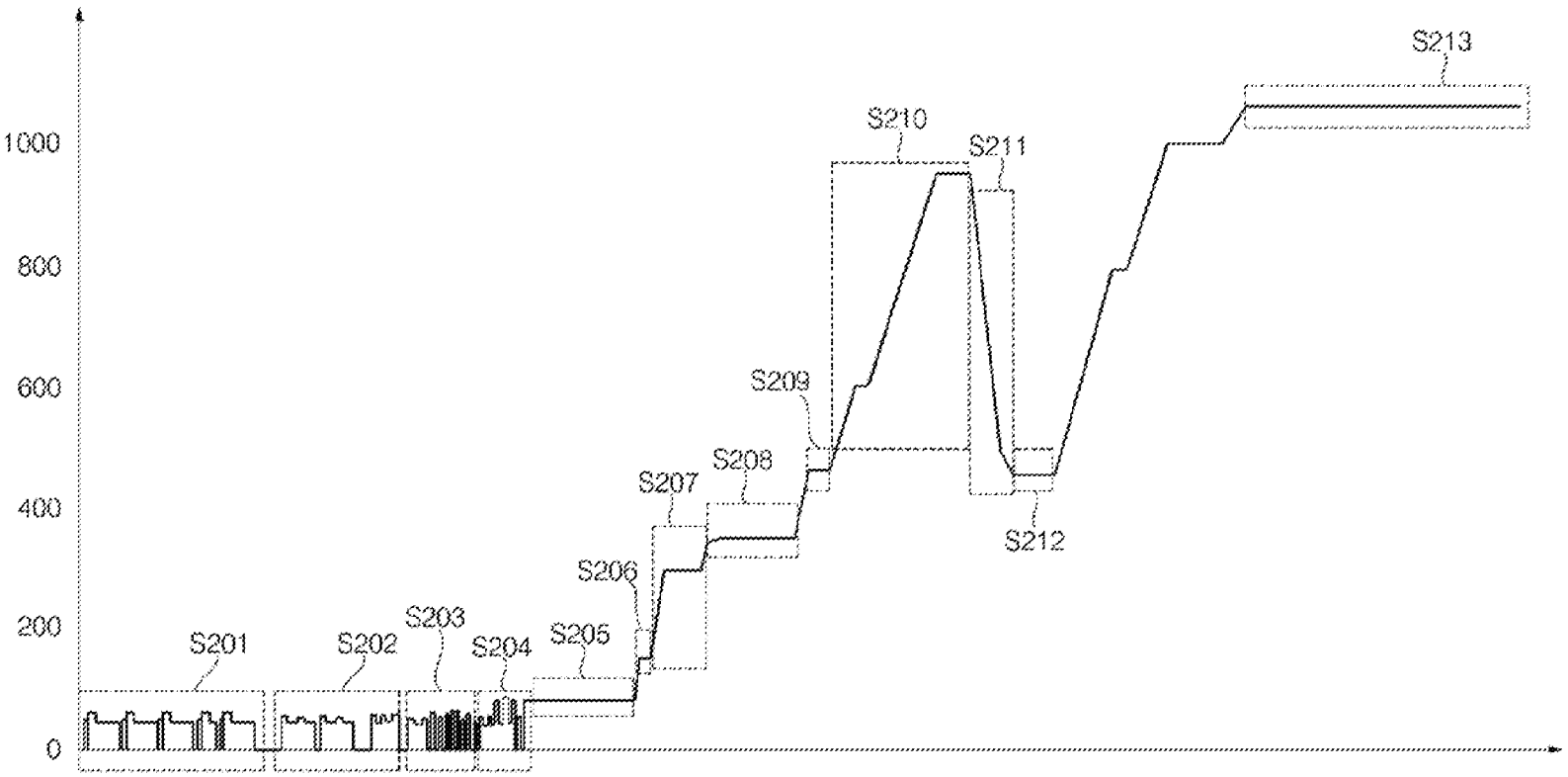
FIG. 13 is a diagram illustrating a rotation speed of a drum at the beginning of spin-drying and in the course of spin-drying by a main washer according to an embodiment of the present disclosure.
Figure 14:
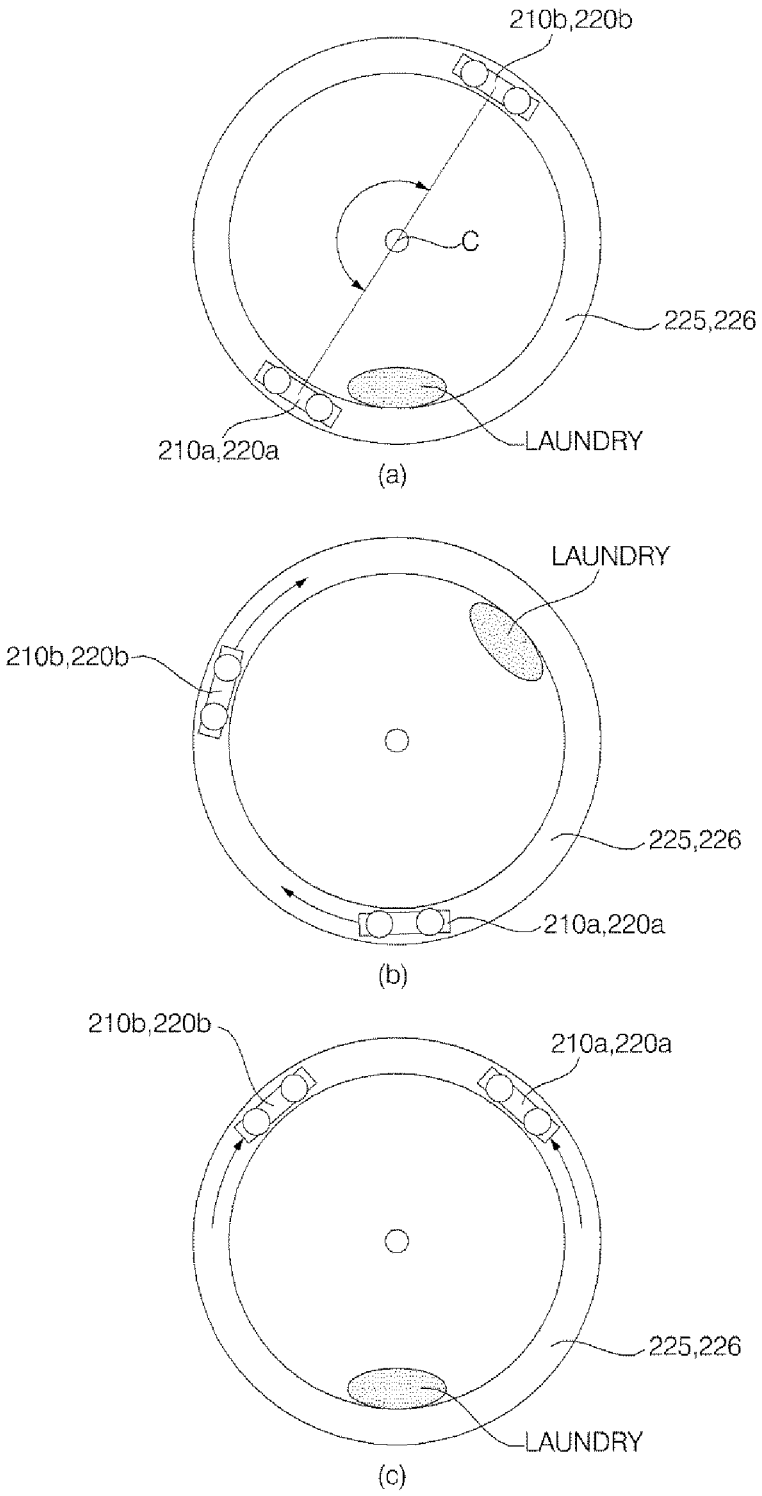
FIG. 14 is a diagram illustrating a process of controlling a balancing unit at the beginning of spin-drying and in the course of spin-drying by a main washer according to an embodiment of the present disclosure.

FIG. 13 is a diagram illustrating a rotation speed of a drum 224 at the beginning of spin-drying and in the course of spin-drying by the main washer 200, and FIG. 14 is a diagram illustrating a process of controlling a balancing unit 210*a*, 210*b* at the beginning of spin-drying and in the course of spin-drying by the main washer 200.

The controller 290 performs rinsing in S201 by controlling the drum motor 213 to rotate the drum 224 in one direction so that after laundry is lifted, the laundry is separated from an inner circumference of the drum 224 and is dropped. The rinsing is a process of rotating the drum 224 at a rotational speed with centrifugal force being equal to or less than 1G to remove remaining detergent and contaminants of the laundry. The controller 290 controls the pump 236 to circulate wash water contained in the tub 222 and spray the wash water into the drum 224 through the circulation nozzle 227. During the rinsing process, the controller 290 controls the drum motor 213 so that the drum 224 rotates, for example, at 46 RPM for a predetermined period of time, stops rotating, and then rotates again at 46 RPM.

In the final stage of rinsing, the controller 290 may direct a motion of the first front balancing unit 210*a* and/or the second front balancing unit 210*b*, so that an angle between the first front balancing unit 210*a* and the second front balancing unit 210*b* becomes substantially 180 degrees with respect to the center of rotation of the drum 224, and the controller 290 may manage a movement of the first rear balancing unit 220*a* and/or the second rear balancing unit 220*b*, so that an angle between the first rear balancing unit 220*a* and the second rear balancing unit 220*b* becomes substantially 180 degrees with respect to the center of rotation of the drum 224 in S202. In this case, the controller 290 continues the rinsing process by controlling the drum motor 210, so that the drum 224 repeatedly rotates at 46 RPM, which is a rotational speed with centrifugal force being equal to or less than 1G, for a predetermined period of time, stops rotating, and then rotates again at 46 RPM.

Thus, by the control of the controller 290, at least one of the first front balancing unit 210*a* and the second front balancing unit 210*b* may move along the front guide rail 225, so that the included angle therebetween becomes substantially 180 degrees with respect to the center (C) of rotation of the drum 224, as illustrated in section (a) of FIG. 14. Similarly, by the control of the controller 290, at least one of the first rear balancing unit 220*a* and the second rear balancing unit 220*b* may move along the rear guide rail 226 so that the included angle therebetween becomes substantially 180 degrees with respect to the center (C) of rotation of the drum 224 as illustrated in (a) of FIG. 14.

In this example, the controller 290 manages the included angle between the first front balancing unit 210*a* and the second front balancing unit 210*b* to both correspond to 180 degrees, and manages the included angle between the first rear balancing unit 220*a* and the second rear balancing unit 220*b* to be approximately 180 degrees, so that imbalance caused by the plurality of front balancing units 210 and the plurality of rear balancing units 220 may be minimized during a first rough balancing, which will be described later.

After the rinsing in S201 and S202, the controller 290 operates the pump 236 to drain the wash water contained in the tub 222 through the drain passage 238 in S203. The controller 290 controls the drum motor 213 during the drainage to repeat acceleration and deceleration of the drum 224. When the water level of the tub 222, which is measured by the water level sensor 221, is sufficiently lowered to a level for spin-drying, the controller 290 stops the operation of the pump 236 and stops drainage.

After the drainage in S203, the controller 290 controls the drum motor 213 to repeat acceleration and deceleration of the drum 224, and senses a vibration amount of the tub 222 through the front vibration sensor 229*a* and/or the rear vibration sensor 229*b* in S204. The controller 290 distributes the laundry by controlling the drum motor 213 to repeat acceleration and deceleration of the drum 224 at a rotational speed (e.g., 80 RPM) at which the laundry starts to cling to the inner circumference of the drum 224. The distribution of laundry is performed by accelerating the drum 224 to the speed of rotation with centrifugal force being about 1 G, and then decelerating the drum 224, so that the laundry may be uniformly distributed without leaning to one side.

The front vibration sensor 229*a* and/or the rear vibration sensor 229*b* measure the vibration amount of the tub 222 when the drum 224 is repeatedly accelerated and decelerated. When the vibration amount of the tub 222, which is measured by the front vibration sensor 229*a* and/or the rear vibration sensor 229*b*, is greater than a predetermined vibration amount for entry into a spin-drying process, the controller 290 continues distribution of laundry by repeating acceleration and deceleration of the drum 224. When the vibration amount of the tub 222, which is measured by the front vibration sensor 229*a* and/or the rear vibration sensor 229*b*, does not exceed the predetermined vibration amount for entry into a spin-drying process, the controller 290 proceeds to a next process.

Generally, the laundry leans to a rear side of the drum 224, such that the rear vibration amount of the tub 222 is greater than the front vibration amount thereof. In the embodiment, when the rear vibration amount of the tub 222, which is measured by the rear vibration sensor 229*b*, does not exceed the predetermined vibration amount for entry into a spin-drying process, the controller 290 proceeds to the following process.

The controller 290 performs first rough balancing in S205 by controlling the drum motor 213 to rotate the drum 224 at the speed of rotation at which the laundry starts to cling to the inner circumference of the drum 224 (e.g., 80 RPM), and by controlling the plurality of front balancing units 210 and the plurality of rear balancing units 220. During the first rough balancing in S205, the controller 290 may operate the pump 236 to drain the wash water contained in the tub 222 to the outside through the drain passage 238. The controller 290 may further control the drum motor 213 to rotate the drum 224 while maintaining the rotation speed at 80 RPM or other speed of rotation at which the centrifugal force is about 1G. When the drum 224 rotates while maintaining the rotation speed at 80 RPM during the first rough balancing, the controller 290 performs direct balancing by controlling the plurality of front balancing units 210 and the plurality of rear balancing units 220.

The direct balancing in S205 is performed by moving the plurality of front balancing units 210 so that the front vibration amount of the tub 222, which is measured by the front vibration sensor 229*a*, may not exceed a predetermined front vibration amount of the first rough balancing; and by moving the plurality of rear balancing units 220 so that the rear vibration amount of the tub 222, which is measured by the rear vibration sensor 229*a*, may not exceed a predetermined rear vibration amount of the first rough balancing. In certain examples, the predetermined rear vibration amount of the first rough balancing in S205 may be greater than the predetermined front vibration amount of the first rough balancing.

Hereinafter, the direct balancing will be described with reference to sections (b) and (c) of FIG. 14 by using the plurality of front balancing units 210 as an example. As illustrated in section (b) of FIG. 14, the controller 290 moves the first front balancing unit 210*a* and the second front balancing unit 210*b* in the same rotational direction. The controller 290 moves the first front balancing unit 210*a* and the second front balancing unit 210*b* in the same rotational direction until the front vibration amount of the tub 222, which is measured by the front vibration sensor 229*a*, is reduced. When the front vibration amount of the tub 222, which is measured by the front vibration sensor 229*a*, is increased, the controller 290 moves the first front balancing unit 210*a* and the second front balancing unit 210*b* in the same opposite rotational direction. The controller 290 stops the movement of the first front balancing unit 210*a* and the second front balancing unit 210*b* at a point where the front vibration amount of the tub 222, which is measured by the front vibration sensor 229*a*, is minimized.

The controller 290 may direct motions of the first front balancing unit 210*a* and the second front balancing unit 210*b* in the same rotational direction to minimize the front vibration amount of the tub 222 that is measured by the front vibration sensor 229*a*, and then causes the first front balancing unit 210*a* and the second front balancing unit 210*b* to move in different directions as illustrated in (c) of FIG. 14. The controller 290 causes the first front balancing unit 210*a* and the second front balancing unit 210*b* to move in a direction where the included angle between the first front balancing unit 210*a* and the second front balancing unit 210*b* based on the center (C) of rotation of the drum 224 is narrowed until the front vibration amount of the tub 222, which is measured by the front vibration sensor 229*a*, is reduced. When the front vibration amount of the tub 222, which is measured by the front vibration sensor 229*a*, is increased, the controller 290 directs the first front balancing unit 210*a* and the second front balancing unit 210*b* to move in a direction where the included angle between the first front balancing unit 210*a* and the second front balancing unit 210*b* is widened. The controller 290 stops the movement of the first front balancing unit 210*a* and the second front balancing unit 210*b* at a point where the front vibration amount of the tub 222, which is measured by the front vibration sensor 229*a*, is minimized.

The controller 290 repeats controlling motions of the first front balancing unit 210*a* and the second front balancing unit 210*b* in different rotational directions to minimize the front vibration amount of the tub 222 that is measured by the front vibration sensor 229*a*, and then controlling motions of the first front balancing unit 210*a* and the second front balancing unit 210*b* in the same rotational direction again to minimize the front vibration amount of the tub 222 that is measured by the front vibration sensor 229*a*.

The controller 290 repeats the process of controlling motions of the plurality of front balancing units 210 in the same rotational direction and in different rotational directions until the front vibration amount of the tub 222, which is measured by the front vibration sensor 229*a*, becomes equal to or smaller than the predetermined front vibration amount of the first rough balancing.

During the direct balancing, the controller 230 performs the above-described process for the first rear balancing unit 220*a* and the second rear balancing unit 220*b*. That is, the controller 290 repeats controlling the motions of the plurality of rear balancing units 220 in the same rotational direction and in different rotational directions until the rear vibration amount of the tub 222, which is measured by the rear vibration sensor 229*b*, becomes equal to or smaller than the predetermined rear vibration amount of the first rough balancing.

During the direct balancing, the controller 290 may first perform direct balancing for the plurality of rear balancing units 220, and may then perform direct balancing for the plurality of the front balancing units 210. As described above, the rear vibration amount of the tub 222 tends to be greater than the front vibration amount of the tub 222, such that the controller 290 may first perform direct balancing for the plurality of rear balancing units 220, and may then perform direct balancing for the plurality of the front balancing units 210.

When the controller 290 performs direct balancing for the plurality of front balancing units 210 upon completing direct balancing for the plurality of rear balancing units 220, the rear vibration amount of the tub 222 may be increased due to movement of the plurality of front balancing units 210. Accordingly, the controller 290 may repeatedly perform direct balancing for the plurality of rear balancing units 220 and direct balancing for the plurality of front balancing units 210.

After the controller 290 completes direct balancing for any balancing units, i.e., either the plurality of front balancing units 210 or the plurality of rear balancing units 220, when the front vibration amount of the tub 222, which is measured by the front vibration sensor 229*a*, is greater than the predetermined front vibration quantity of the first rough balancing or when the rear vibration amount of the tub 222, which is measured by the rear vibration sensor 229*b*, is greater than the predetermined rear vibration amount of the first rough balancing, the controller 290 performs direct balancing for the other balancing units. That is, upon completing a direct balancing of any balancing units, i.e., either the plurality of front balancing units 210 or the plurality of rear balancing units 220, when the front vibration amount of the tub 222, which is measured by the front vibration sensor 229*a* is equal to or smaller than the predetermined front vibration amount of the first rough balancing, and when the rear vibration amount of the tub 222, which is measured by the rear vibration sensor 229*b*, is equal to smaller than the predetermined rear vibration quantity of the first rough balancing, the controller 290 stops repeating the direct balancing for the plurality of rear balancing units 220 and the direct balancing for the plurality of front balancing units 210.

While the controller 290 is performing the direct balancing for the plurality of rear balancing units 220 and the direct balancing for the plurality of front balancing units 210, and the direct balancing is repeated three times or more, the controller 290 may controls the drum motor 213 to halt the drum 224 and performs distribution of laundry.

When the direct balancing in S205 is successful and both the rear vibration amount of the tub 222, which is measured by the rear vibration sensor 229*b*, does not exceed the predetermined rear vibration amount of the first rough balancing, and the front vibration amount of the tub 222, which is measured by the front vibration sensor 229*a*, does not exceed the predetermined front vibration amount of the first rough balancing, the controller 290 accelerates the drum 224 to proceed to a next process.

The controller 290 performs second rough balancing in S206 by controlling the drum motor 213 to rotate the drum 224 at a speed of rotation at which laundry clings to the inner circumference of the drum 224 while rotating (e.g., 190 RPM), and by controlling the plurality of front balancing units 210 and the plurality of rear balancing units 220. During the second rough balancing in S206, the controller 290 operates the pump 236 to drain the wash water contained in the tub 222 to the outside through the drain passage 238. The controller 290 controls the drum motor 213 so that the drum 224 may rotate while maintaining the speed of rotation at 150 RPM, which is the speed of rotation with centrifugal force being greater than 1G. When the drum 224 rotates while maintaining the speed of rotation at 150 RPM during the second rough balancing, the controller 290 may again perform the above-described direct balancing by controlling the motions of the plurality of front balancing units 210 and the plurality of rear balancing units 220.

During the second rough balancing, the controller 290 moves the plurality of front balancing units 210, so that the front vibration amount of the tub 222, which is measured by the front vibration sensor 229*a*, may not exceed a predetermined front vibration amount of the second rough balancing, and moves the plurality of rear balancing units 220, so that the rear vibration amount of the tub 222, which is measured by the rear vibration sensor 229*b*, may not exceed a predetermined rear vibration amount of the second rough balancing. In one implementation, the rear vibration amount of the second rough balancing may be greater than the front vibration amount of the second rough balancing. For example, as previously described, the laundry may tend to be collected in a rear section of the drum 224. Further, the front vibration threshold amount of the second rough balancing in S206 may be greater than the front vibration threshold amount of the first rough balancing in S205, and the rear vibration threshold amount of the second rough balancing in S206 may be is greater than the rear vibration threshold amount of the first rough balancing in S205 since the rotational speed of the drum 224 is relatively greater in S206.

During the second rough balancing, the controller 290 performs a substantially same direct balancing as the direct balancing performed during the first rough balancing. For example, the controller 290 may control repeated motions of the plurality of front balancing units 210 in the same rotational direction and in different rotational directions until the front vibration amount of the tub 222, which is measured by the front vibration sensor 229*a*, becomes equal to or smaller than the predetermined front vibration amount of the second rough balancing. Further, the controller 290 may control repeated motions of the plurality of rear balancing units 220 in the same rotational direction and in different rotational directions until the rear vibration amount of the tub 222, which is measured by the rear vibration sensor 229*b*, becomes equal to or smaller than the predetermined rear vibration amount of the second rough balancing. In addition, the controller 290 repeats direct balancing for the plurality of rear balancing units 220 and direct balancing for the plurality of front balancing units 210.

When the rear vibration amount of the tub 222, which is measured by the rear vibration sensor 229*b*, does not exceed the predetermined rear vibration amount of the second rough balancing, and the front vibration amount of the tub 222, which is measured by the front vibration sensor 229*a*, does not exceed the predetermined front vibration amount of the second rough balancing, the controller 290 controls the drum motor 213 to perform a next process in the rinsing and drying progression shown in FIG. 13.

As shown in FIG. 13, the controller 290 next controls the drum motor 213 to accelerate the drum 224 to 350 RPM, and controls the front vibration sensor 229*a* and the rear vibration sensor 229*b* to measure the front vibration amount and the rear vibration amount of the tub 222. When the front vibration amount of the tub 222, which is measured by the front vibration sensor 229*a*, exceeds a predetermined front excessive vibration amount, or when the rear vibration amount of the tub 222, which is measured by the rear vibration sensor 229*b*, exceeds a predetermined rear excessive vibration amount, the controller 290 performs excessive balancing in S209 by controlling the drum motor 213 to rotate the drum 224 while maintaining the speed of rotation.

While the drum 224 is accelerated from 150 RPM to 350 RPM, a large vibration may be produced in the main washer 200 due to resonance with a floor surface. Such resonance temporarily occurs when a natural frequency of the floor surface coincides with or is multiple of a vibration frequency of the main washer 200. Accordingly, if vibration is not severe, the controller 290 accelerates the drum 224 to 350 RPM; and only when severe vibration is produced, the controller 290 performs excessive balancing.

Thus, if the front vibration amount of the tub 222, which is measured by the front vibration sensor 229*a*, does not exceed the predetermined front excessive vibration amount, or if the rear vibration amount of the tub 222, which is measured by the rear vibration sensor 229*b*, does not exceed the predetermined rear excessive vibration amount, the controller 290 accelerates the drum 224 to 350 RPM; and if not, the controller 290 performs excessive balancing. In S209, the front excessive vibration amount may be greater than the rear excessive vibration amount. Further, the front excessive vibration amount may be greater than the front vibration amount of the second rough balancing, and the rear excessive vibration amount may be greater than the rear vibration amount of the second rough balancing.

While the drum 224 is accelerated, if the front vibration amount of the tub 222 exceeds the front excessive vibration amount, or if the rear vibration amount of the tub 222 exceeds the rear excessive vibration amount, the controller 290 performs an excessive balancing in S207, in which the controller 290 controls the drum motor 213 to maintain the speed of rotation of the drum 224, and performs the above-described direct balancing for the plurality of front balancing units 210 and the plurality of rear balancing units 220. For example, during the excessive balancing, the controller 290 may control a motion of the plurality of front balancing units 210 so that the front vibration amount of the tub 222, which is measured by the front vibration sensor 229*a*, does not exceed a predetermined front vibration amount of the excessive balancing; and may control a motion of the plurality of rear balancing units 220 so that the rear vibration amount of the tub 222, which is measured by the rear vibration sensor 229*b*, does not exceed a predetermined rear vibration amount of the excessive balancing. In this example, the rear vibration amount of the excessive balancing may be greater than the front vibration amount of the excessive balancing. Further, the front vibration amount of the excessive balancing may be smaller than the front excessive vibration amount, but is equal to or greater than the front vibration amount of the second rough balancing; and the rear vibration amount of the excessive balancing may be smaller than the rear excessive vibration amount, but is equal to or greater than the rear vibration amount of the second rough balancing.

During the excessive balancing in S207, the controller 290 performs a similar direct balancing as the direct balancing performed during the first and the second rough balancing in S205 and S206. For example, the controller 290 may cause the plurality of front balancing units 210 to repeatedly move in the same rotational direction and in different rotational directions until the front vibration amount of the tub 222, which is measured by the front vibration sensor 229*a*, becomes equal to or smaller than the predetermined front vibration amount of the excessive balancing. Further, the controller 290 may cause the plurality of rear balancing units 220 to alternate between moving in the same rotational direction and in different rotational directions until the rear vibration amount of the tub 222, which is measured by the rear vibration sensor 229*b*, becomes equal to or smaller than the predetermined rear vibration amount of the excessive balancing. In addition, the controller 290 may repeat direct balancing for the plurality of rear balancing units 220 and direct balancing for the plurality of front balancing units 210. When the speed of rotation of the drum 224 reaches 350 RPM, the controller 290 may performs a next process in the rinsing and drying progression shown in FIG. 13.

For example, the controller 290 may perform third rough balancing in S208 by controlling the drum motor 213 to rotate the drum 224 at 350 RPM, and controlling the plurality of front balancing units 210 and the plurality of rear balancing units 220. During the third rough balancing, it is desired that the controller 290 operates the pump 236 to drain the wash water contained in the tub 222 to the outside through the drain passage 238. When the drum 224 rotates while maintaining the speed of rotation at 350 RPM during the third rough balancing, the controller 290 performs the above-described direct balancing by controlling the plurality of front balancing units 210 and the plurality of rear balancing units 220.

During the third rough balancing, the controller 290 controls motions of the plurality of front balancing units 210 so that the front vibration amount of the tub 222, which is measured by the front vibration sensor 229*a*, does not exceed a predetermined front vibration amount of the third rough balancing; and controls motions of the plurality of rear balancing units 220, so that the rear vibration amount of the tub 222, which is measured by the rear vibration sensor 229*b*, does not exceed a predetermined rear vibration amount of the third rough balancing. If the speed of rotation of the drum 224 exceeds 350 RPM, large vibration may be suddenly produced even by a small imbalance. Accordingly, the front vibration amount of the third rough balancing is smaller than the above-described front vibration amount of the first rough balancing, and the rear vibration amount of the third rough balancing is smaller than the above-described rear vibration amount of the first rough balancing. Further, the rear vibration amount of the third rough balancing is equal to or greater than the front vibration amount of the third rough balancing.

During the third rough balancing, the controller 290 may perform a similar direct balancing as the direct balancing performed during the first and the second rough balancing. For example, the controller 290 may control the plurality of front balancing units 210 to alternate between moving in the same rotational direction and in different rotational directions until the front vibration amount of the tub 222, which is measured by the front vibration sensor 229*a*, becomes equal to or smaller than the predetermined front vibration amount of the third rough balancing. Further, the controller 290 may control the plurality of rear balancing units 220 to alternate between moving in the same rotational direction and in different rotational directions until the rear vibration amount of the tub 222, which is measured by the rear vibration sensor 229*b*, becomes equal to or smaller than the predetermined rear vibration amount of the third rough balancing. In addition, the controller 290 may repeat direct balancing for the plurality of rear balancing units 220 and direct balancing for the plurality of front balancing units 210.

When the rear vibration amount of the tub 222, which is measured by the rear vibration sensor 229*b*, does not exceed the predetermined rear vibration amount of the third rough balancing, and the front vibration amount of the tub 222, which is measured by the front vibration sensor 229*a*, does not exceed the predetermined front vibration amount of the third rough balancing, the controller 290 accelerates the drum 224 to perform a next process next process in the rinsing and drying progression shown in FIG. 13.

The controller 290 may perform a first fine balancing in S209 by controlling the drum motor 213 to rotate the drum 224 at 460 RPM, and controlling the plurality of front balancing units 210 and the plurality of rear balancing units 220. During the first fine balancing, it is desired that the controller 290 operates the pump 236 to drain the wash water contained in the tub 222 to the outside through the drain passage 238. When the drum 224 rotates while maintaining the speed of rotation at 460 RPM during the first fine balancing, the controller 290 may control the plurality of front balancing units 210 and the plurality of rear balancing units 220 to perform the above-described direct balancing and correction balancing.

When the drum 224 rotates at the speed of rotation of 600 RPM or higher, wash water contained in laundry is significantly reduced, such that the center of gravity of the drum 224 is changed, thereby causing a potential imbalance. However, when the speed of rotation of the drum 224 exceeds 460 RPM, balancing may not be performed since the plurality of front balancing units 210 and the plurality of rear balancing units 220 may not move actively by the motor 204. Accordingly, when the drum 224 rotates at 600 RPM or higher (a period of "dehydration" to be described later), correction balancing may be performed at 460 RPM, during which balancing may be performed by anticipating the change of imbalance caused by reduction in the water content of the laundry.

During the direct balancing in the first fine balancing, the controller 290 may control the movement of the plurality of front balancing units 210, so that the front vibration amount of the tub 222, which is measured by the front vibration sensor 229*a*, does not exceed a predetermined front vibration amount of the fine balancing, and may control the movement of the plurality of rear balancing units 220 so that the rear vibration amount of the tub 222, which is measured by the rear vibration sensor 229*b*, does not exceed a predetermined rear vibration amount of the fine balancing. If the speed of rotation of the drum 224 exceeds 350 RPM, large vibration may be suddenly produced even by a small imbalance. Accordingly, the front vibration amount of the fine balancing is smaller than the above-described front vibration amount of the third rough balancing, and the rear vibration amount of the fine balancing is smaller than the above-described rear vibration amount of the third rough balancing. Further, the rear vibration amount of the fine balancing is equal to or greater than the front vibration amount of the fine balancing.

During the direct balancing in the first fine balancing process, the controller 290 may perform a substantially similar direct balancing as the direct balancing performed during the above-described rough balancing. For example, the controller 290 may control the plurality of front balancing units 210 to alternative between moving in the same rotational direction and moving in different rotational directions until the front vibration amount of the tub 222, which is measured by the front vibration sensor 229*a*, becomes equal to or smaller than the predetermined front vibration amount of the fine balancing. Further, the controller 290 controls the plurality of rear balancing units 220 to repeatedly alternatively between moving in the same rotational direction and moving in different rotational directions until the rear vibration amount of the tub 222, which is measured by the rear vibration sensor 229*b*, becomes equal to or smaller than the predetermined rear vibration amount of the fine balancing. In addition, the controller 290 repeats direct balancing for the plurality of rear balancing units 220 and direct balancing for the plurality of front balancing units 210.

When the rear vibration amount of the tub 222, which is measured by the rear vibration sensor 229*b*, does not exceed the predetermined rear vibration amount of the fine balancing, and when the front vibration amount of the tub 222, which is measured by the front vibration sensor 229*a*, does not exceed the predetermined front vibration amount of the fine balancing, the controller 290 performs correction balancing.

The correction balancing may be performed by moving the plurality of front balancing units 210 and the plurality of rear balancing units 220 by anticipating the change of imbalance caused by reduction in the water content of the laundry when the drum 224 rotates at 600 RPM or higher. During the correction balancing, the controller 290 moves the plurality of front balancing units 210 and the plurality of rear balancing units 220 by applying a change of water content predetermined according to the types of laundry. The controller 290 may determine the types of laundry according to wash cycles set by a user for the types of laundry. Further, the controller 290 may determine the types of laundry based on an amount of laundry, which is the weight of laundry measured at the initial stage of washing, and based on the front vibration amount and the rear vibration amount of the tub 222, which are measured during the first to third balancing.

The controller 290 calculates, through experiment, the change of imbalance caused by the change of water content according to the types of laundry. Based on the calculated change of imbalance, the controller 290 calculates a front first variation value, which is a variation value of the included angle between the plurality of front balancing units 210, and a rear first variation value, which is a variation value of the included angle of the plurality of rear balancing units 220, and the controller 290 stores the calculated values. The controller 290 controls the plurality of front balancing units 210 to move in different rotational directions, to change the included angle between the first front balancing unit 210*a* and the second front balancing unit 210*b* by a predetermined front first variation value. Further, the controller 290 controls the plurality of rear balancing units 220 to move in different rotational directions, to change the included angle between the first rear balancing unit 220*a* and the second rear balancing unit 220*b* by a predetermined rear first variation value.

Generally, as the water content of laundry is reduced when the drum 224 rotates at 600 RPM or higher, the front first variation value and the rear first variation value are set so that the included angles may increase. Accordingly, during the correction balancing in the first fine balancing process, the controller 290 may increase the included angle of the plurality of front balancing units 210 by the front first variation value, and may increase the included angle of the plurality of rear balancing units 220 by the rear first variation value.

Upon completing the correction balancing in the first fine balancing process, the controller 290 controls the drum motor 204 to perform a next process in the rinsing and drying procedure shown in FIG. 13. Depending on the types of laundry and washing cycles, the correction balancing described above in the first fine balancing process may be omitted.

The controller 290 performs first dehydration in S210 by controlling the drum motor 213 to accelerate the drum to 950 RPM to remove moisture contained in laundry, and by controlling the front vibration sensor 229*a* and the rear vibration sensor 229*b* to measure the front vibration amount and the rear vibration amount of the tub 222. During the first dehydration, the controller 290 intermittently operates the pump 236 to drain the wash water contained in the tub 222 to the outside through the drain passage 238. The front vibration amount and the rear vibration amount of the tub 222, which are measured during the first dehydration, are used for correction balancing in a second fine balancing process which will be described later.

After the speed of rotation of the drum 224 reaches 950 RPM (or other relatively high rotational speed for drying the laundry) and is maintained for a few seconds, the controller 290 performs a next process. The controller 290 controls the drum motor 213 to halt the drum 224, and senses the amount of laundry, which is the weight of the laundry, in S211. Upon controlling the drum motor 213 to halt the drum motor 213, the controller 290 senses the amount of the laundry by measuring time taken for the drum 224 to decelerate to a predetermined rotation speed (500 RPM in the embodiment shown in FIG. 13). When the deceleration time gets longer, the controller may determine that the weight of the laundry relatively heavy, indicating a high level of the laundry amount. The controller 290 stores the relationship between the deceleration time and the laundry amount, which is obtained through experiment, and calculates the amount of the laundry based on the relationship. Based on the sensed amount of the laundry, the controller 290 performs correction balancing in a second fine balancing process and second dehydration, which will be described below.

Upon sensing the amount of the laundry, the controller 290 controls the drum motor 213 to rotate the drum 224 at 460 RPM and performs a next process. The controller 290 performs second fine balancing in S212 by controlling the drum motor 213 to rotate the drum 224 at 460 RPM, and controlling the plurality of front balancing units 210 and the plurality of rear balancing units 220. When the drum 224 rotates while maintaining the speed of rotation at 460 RPM during the second fine balancing, the controller 290 performs the above-described direct balancing and correction balancing by controlling the plurality of front balancing units 210 and the plurality of rear balancing units 220. The direct balancing in the second fine balancing process is similar to the direct balancing in the first fine balancing process, such that detailed description thereof will be omitted.

The purpose of correction balancing in the second fine balancing process is the same as the purpose of correction balancing in the first fine balancing process. However, during the correction balancing in the second fine balancing process, a front second variation value, which is a variation value of the included angle between the plurality of front balancing units 210, and a rear second variation value, which is a variation value of the included angle between the plurality of rear balancing units 220, are determined based on the front vibration amount and the rear vibration amount of the tub 222 which are measured during the first dehydration, and based on the amount of laundry which is measured while the amount of laundry is sensed at a high speed. During the second dehydration process which will be described later, the drum 224 rotates at a very high speed, such that large vibration may be produced even by a small imbalance, requiring further precise correction balancing.

Based on the change of water content according to the types of laundry, as well as the front vibration amount and the rear vibration amount of the tub 222 which are measured during the first dehydration, and the amount of laundry which is measured while the amount of laundry is sensed at a high speed, the controller 290 calculates the front second variation value and the rear second variation value, and stores the calculated values. The controller 290 controls the plurality of front balancing units 210 to move in different directions, to change the included angle between the first front balancing unit 210*a* and the second front balancing unit 210*b* by a predetermined front second variation value. Further, the controller 290 controls the plurality of rear balancing units 220 to move in different directions, to change the included angle between the first rear balancing unit 220*a* and the second rear balancing unit 220*b* by a predetermined rear second variation value.

The front second variation value and the rear second variation value are set so that the included angles may increase or decrease, since the front second variation value and the rear second variation value are determined in consideration of the water content of laundry, as well as the front vibration amount and the rear vibration amount of the tub 222, which are measured during the first dehydration, and the amount of laundry which is measured while the amount of laundry is sensed at a high speed.

Accordingly, during the correction balancing in the first fine balancing process, the controller 290 increases or decreases the included angle between the plurality of front balancing units 210 by the front first variation value, and increases or decreases the included value between the plurality of rear balancing units 220 by the rear first variation value.

Upon completing the correction balancing in the second fine balancing process, the controller 290 controls the drum motor 204 to perform a next process. Depending on the types of laundry, wash cycles, the amount of laundry which is measured while the amount of laundry is sensed at a high speed, and the front vibration amount and the rear vibration amount of the tub 222 which are measured during the first dehydration, the above-described correction balancing in the second fine balancing process may be omitted.

The controller 290 performs second dehydration in S213 by controlling the drum motor 213 to accelerate the drum 224 to a maximum rotation speed to remove moisture contained in laundry. When the speed of rotation exceeds 1000 RPM, resonance occurs between the main washer 200 and the floor surface, such that the controller 290 sets the maximum rotation speed according to the amount of laundry which is measured while the amount of laundry is sensed at a high speed. In the embodiment, when the amount of laundry, which is measured while the amount of laundry is sensed at a high speed, is lower than a predetermined reference laundry amount sensed at a high speed, the controller 290 sets the maximum rotation speed to be 1060 RPM; and When the amount of laundry, which is measured while the amount of laundry is sensed at a high speed, is greater than the predetermined reference laundry amount sensed at a high speed, the controller 290 sets the maximum rotation speed to be 1010 RPM. During the second dehydration, the controller 290 intermittently operates the pump 236 to drain the wash water contained in the tub 222 to the outside through the drain passage 238. After rotating the drum 224 at the maximum rotation speed for a predetermined period of time, the controller 290 controls the drum motor 213 to halt the drum 224, and terminates dehydration.

Figure 15:
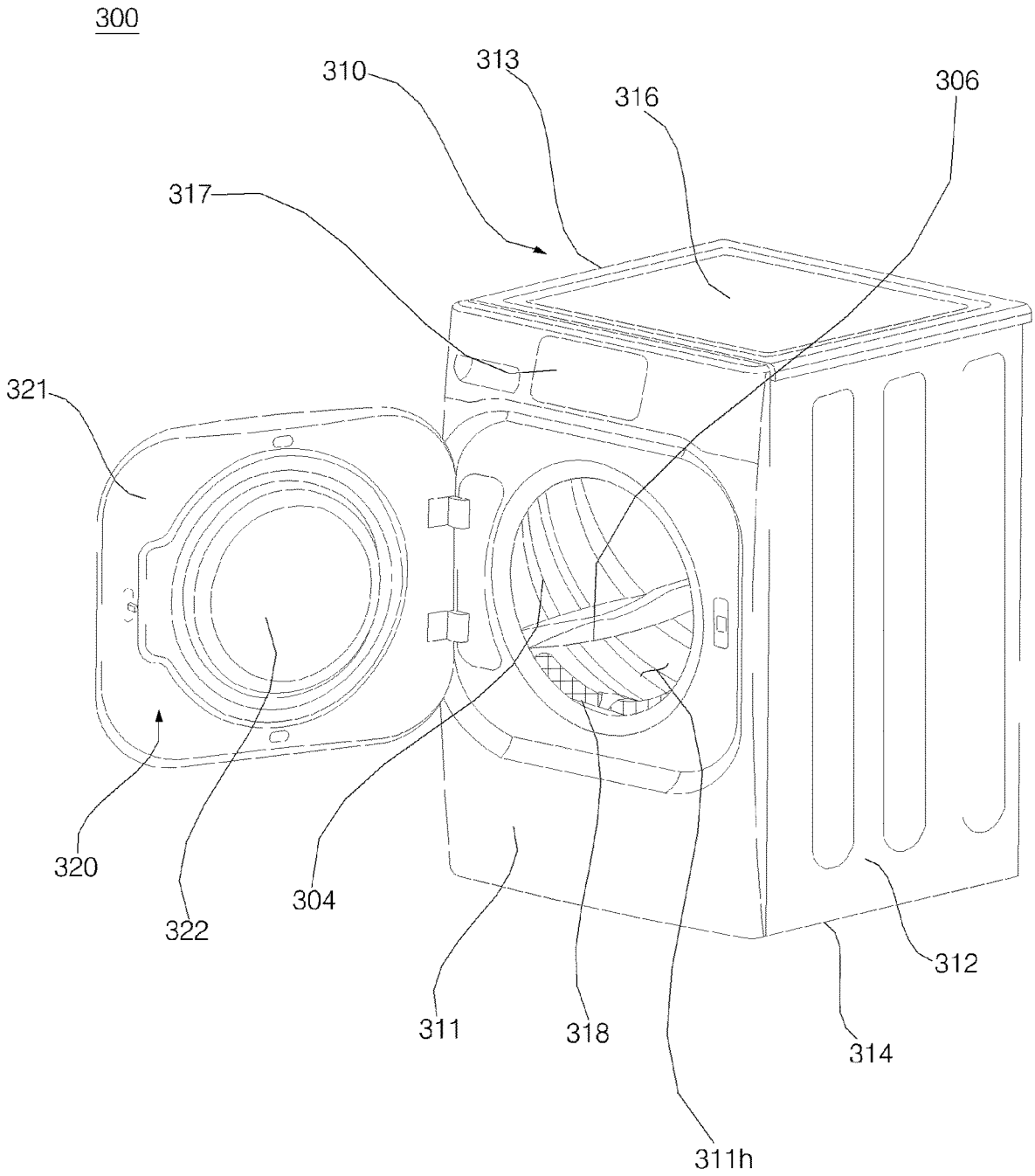
FIG. 15 is a perspective view of a dryer illustrated in FIG. 1.
Figure 16:
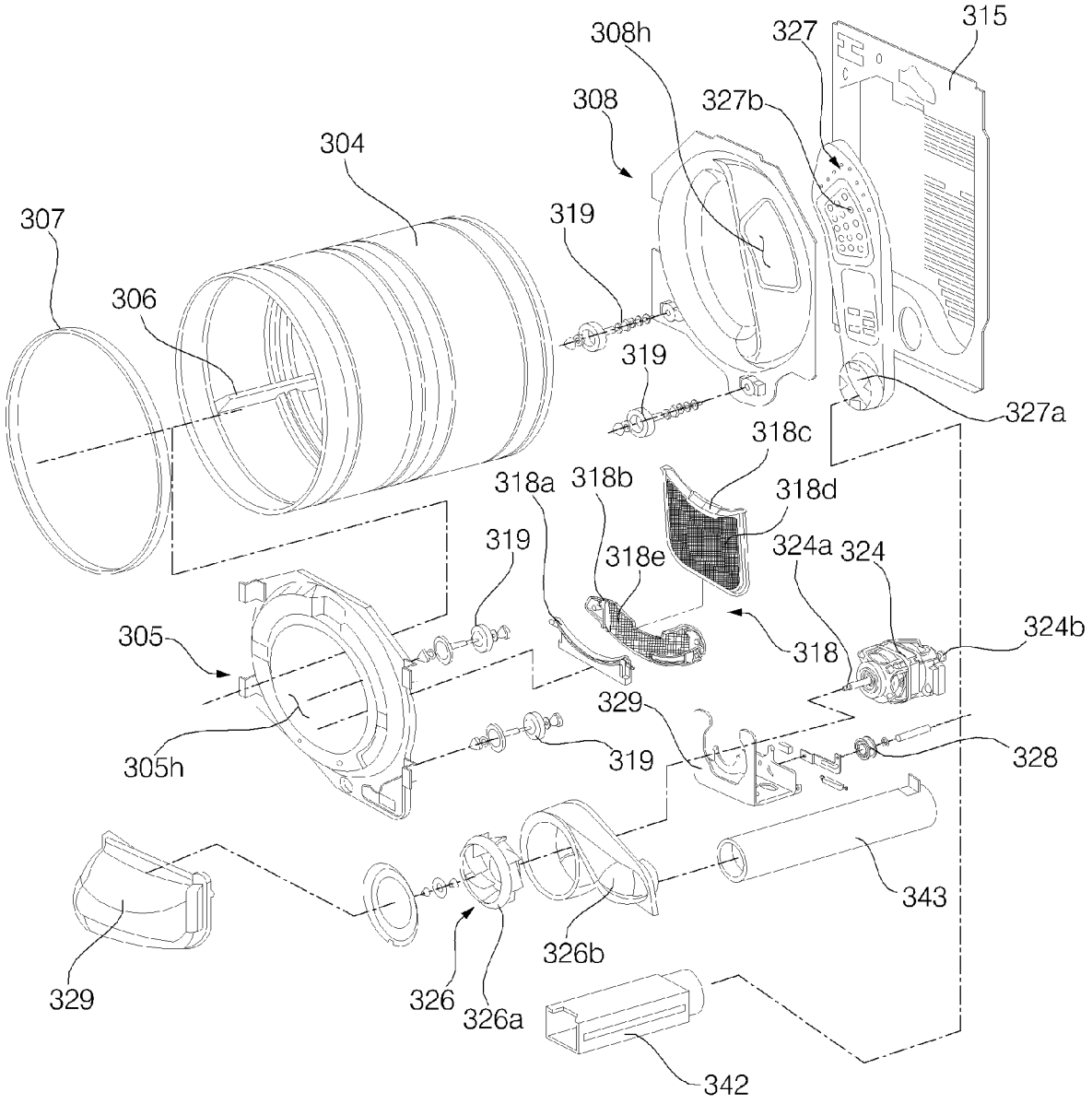
FIG. 16 is an exploded perspective view of the dryer illustrated in FIG. 15.
Figure 17:
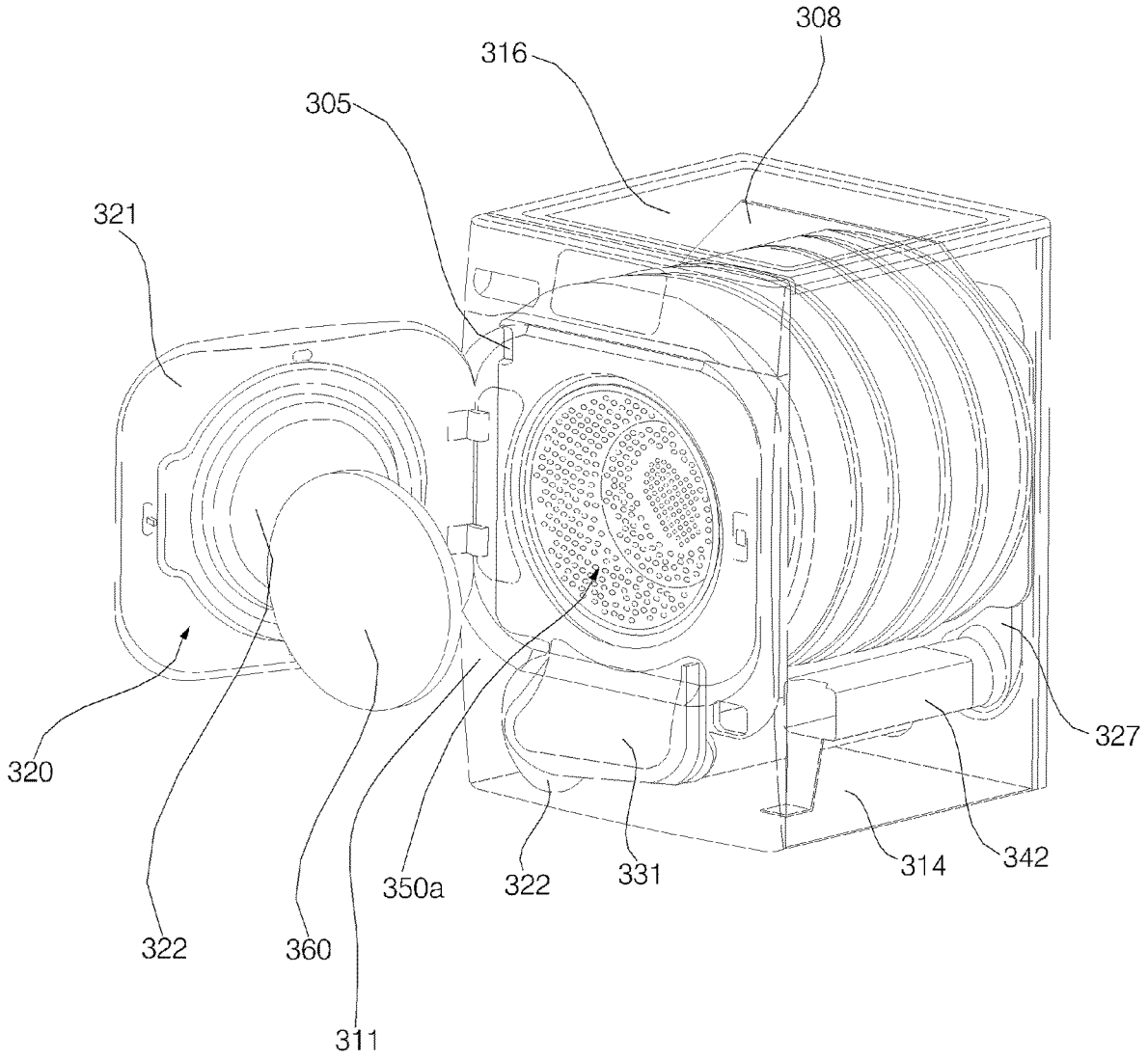
FIG. 17 is a view of the dryer illustrated in FIG. 15 which is partially cut to show the inside thereof.

The dryer 300 will be described as follows. FIG. 15 is a perspective view of the dryer 300, and FIG. 16 is an exploded perspective view of the dryer 300. Referring to FIGS. 15 and 16, a casing 310 forms an external appearance of the dryer 300, and provides a space where a drum 304 and other elements are provided. The casing 310 includes a front panel 311, a right plate 312, a left plate 313, a base 314, a top plate 316, and a back panel 315.

The base 314 is formed to be approximately flat panel, and has the front panel 311, the right plate 312, the left plate 313, and the back panel 315 provided thereon. The front panel 311, the right plate 312, the left plate 313, the top plate 316, and the back panel 315 form the front surface, the right surface, the left surface, the top surface, and the back surface of the casing 310 respectively.

The front panel 311 may have an introduction port 311*h*, and a door 320 may be provided to open and close the introduction port 311*h*. The door 320 has a door frame 321 which is rotatably connected to the front panel 311; and a door glass 322 which is installed at the door frame 321. The door frame 321 has an opening formed approximately at the center of the front panel 311, and the door glass 322 is installed at the opening. The door glass 322 is made of a transparent material so that a user may see into the drum 304 when the door 320 is closed, and may have a convex shape protruding inwards of the drum 304.

A control panel 317 may be provided on the top of the front panel 311. The control panel 317 may be provided with a display (e.g., LCD panel, LED panel, etc.) which shows an operation state of a clothes dryer, and an input part (e.g. button, dial, touch screen, etc.) which receives input of operation commands of the clothes dryer from a user.

The drum 304 may be rotatably provided inside the casing 310. Further, a main motor 324 may be provided inside the casing 310 to rotate the drum 304. The drum 304 has a substantially cylindrical shape having a front surface and a rear surface which are open, and the front surface communicates with the introduction port 311*h*.

A lifter (or protrusion) 306 to lift up clothes may be provided at the inner circumference of the drum 304. The lifter 306 protrudes from the inner circumference of the drum 304, and may be elongated horizontally. A plurality of the lifters 306 may be provided along the inner circumference of the drum 304. While the drum 304 rotates, the lifter 306 repeatedly lifts and drops the clothes.

A front supporter (or front drum frame) 305 and a rear supporter (or rear drum frame) 308, which rotatably support the drum 304, are provided inside the casing 310. The front supporter 305 and the rear supporter 308 support the front end and the rear end of the drum 304 respectively. The front supporter 305 and the rear supporter 308 may have a guide which is formed to be a ring-shaped protrusion or a groove. As the front end or the rear end of the drum 304 is engaged with the guide, the drum 304 may stably rotate. Each of the front supporter 305 and the rear supporter 308 may be provided with a roller 319 which supports the drum 304. An outer circumference of the drum 304 may come into contact with the roller 319.

A bracket 329 is fixed on the base 314, and the main motor 324 may be supported by the bracket 329. The main motor 324 provides power to rotate the drum 304, and at the same time rotates a blower fan 326 which will be described later. The main motor 324 may be a biaxial motor, and has a first driving axis 324*a* connected to the blower fan 326 and a second driving axis 324*b* having a driving pulley with which a belt wound around the drum 304 is engaged.

An idle pulley 328 may be installed at the bracket 329 to adjust tension of the belt. While the belt is engaged with the driving pulley and the idle pulley 328, the belt surrounds the outer circumference of the drum 304. While the main motor 324 operates, the belt is transferred by the driving pulley, and the drum rotates 304 by a frictional force applied between the belt and the driving pulley.

The blower fan 326 may rotate by the main motor 324. By the rotation of the blower fan 326, air inside the drum 304 is introduced into an air intake duct 331. More specifically, a passage (not shown) is provided at a lower side of an opening 305*h* of the front supporter 305 to discharge air to the outside, and the air intake duct 331 guides the air, discharged through the passage, to the blower fan 326.

When the blower fan 326 rotates, the air discharged from the drum 304 is guided by the air intake duct 331 to be supplied to the blower fan 326. The air intake duct 331 is connected to a front surface of the front supporter 305, and communicates with an intake port of the blower fan 326.

The blower fan 326 includes a centrifugal fan 326*a* which is connected to the first driving axis 324*a* of the main motor 324, and a fan housing 326*b* which accommodates the centrifugal fan 326*a*. The fan housing 326*b* may be provided with: an inlet through which the air guided through the air intake duct 331 is introduced; and an outlet through which the air propelled by the centrifugal fan 326*a* is discharged. The outlet is connected with an air discharge duct 343 which comes into contact with the outside air, and the air discharged through the outlet is discharged to the outside through the casing 310.

The front supporter 305 may be provided with a filter assembly 318. The filter assembly 318 collects lint floating in the air discharged from the drum 304. The filter assembly 318 includes: filter cases 318*a* and 318*b* which are fixed at the front supporter 305; and a lint filter 318*c* which is detachable from the filter cases 318*a* and 318*b*. The filter cases 318*a* and 318*b* forms a space to accommodate the lint filter 318*c* (hereinafter referred to as an "accommodation space"), and a filter insertion hole is provided on the top surface of the filter cases 318*a* and 318*b*, so that the lint filter 318*c* may be inserted into the accommodation space through the lifter insertion hole. The lint filter 318*c* may be inserted into or drawn out of the accommodation space through the filter insertion hole.

The filter cases 318*a* and 318*b* may include a front case 318*a* and a rear case 318*b*. The front case 318*a* may be connected to a rear surface of the front supporter 305. The rear case 318*b* is connected to the rear surface of the front case 318*a*, such that an accommodation space may be formed between the rear case 318*b* and the front case 318*a*. The rear case 318*b* may be provided with a grille 318*e*, so as to introduce air in the drum 304 into the accommodation space.

The lint filter 318*c* may include a filter screen 318*d* of a mesh structure having minute holes. After the air introduced through the grille 318*e* is filtered by the filter screen 318*d*, the air is guided to the air intake duct 331 through a passage formed at the front supporter 305.

Figure 18:
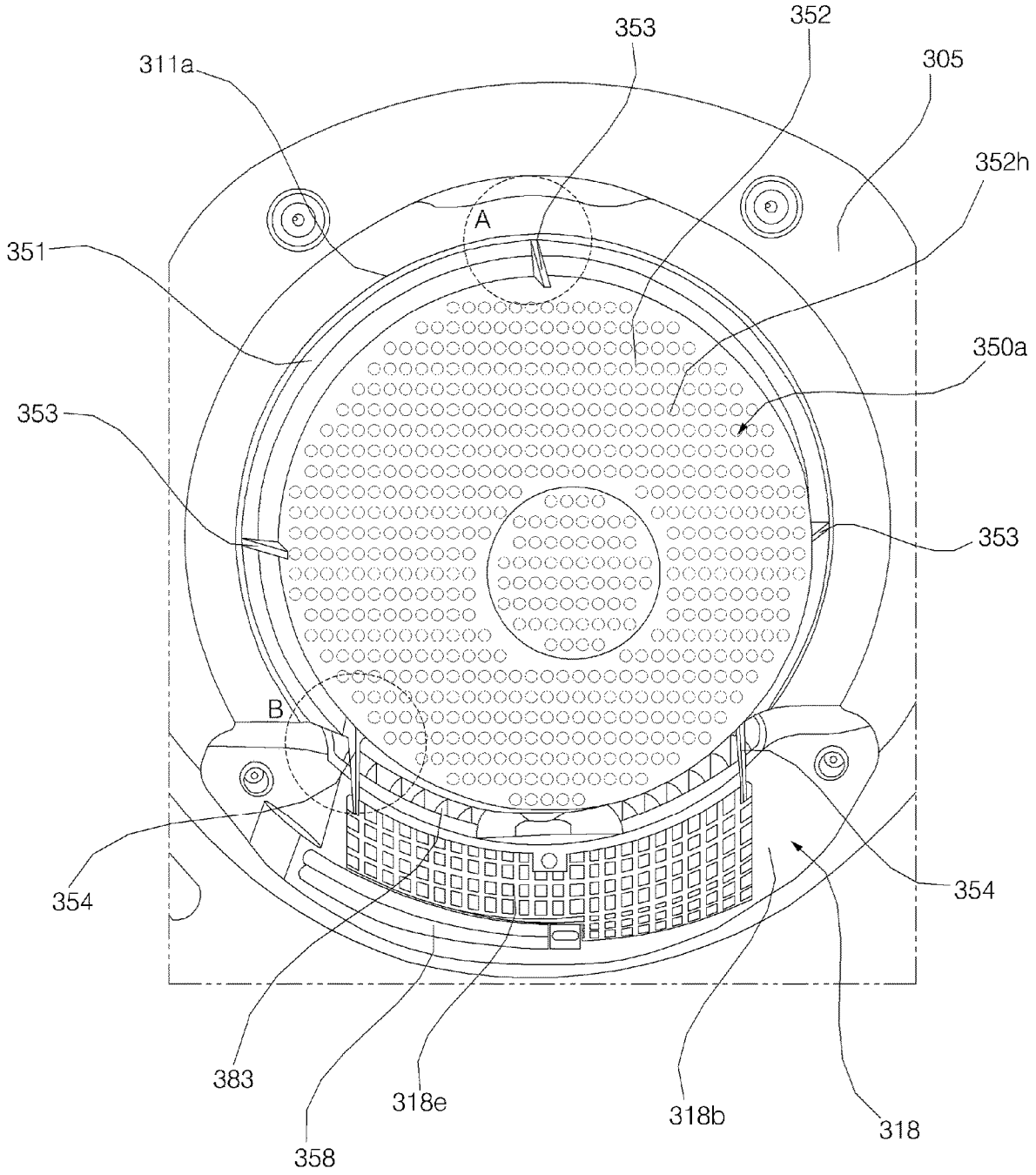
FIG. 18 is a view illustrating a state where a basket is installed, as seen from a rear side.
Figure 19:
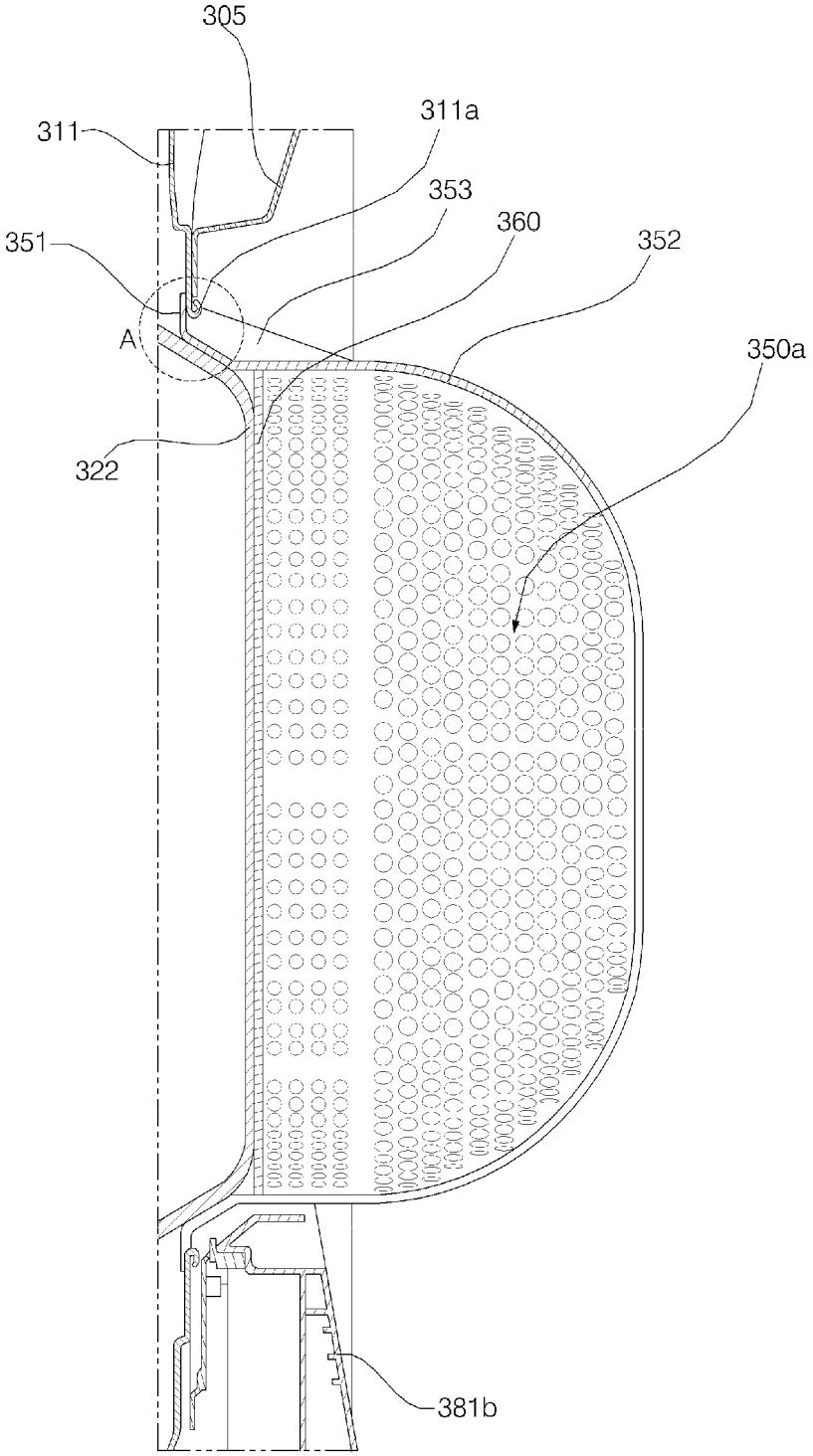
FIG. 19 is a cross-sectional view illustrating a connection structure of a basket and a casing.
Figure 20:
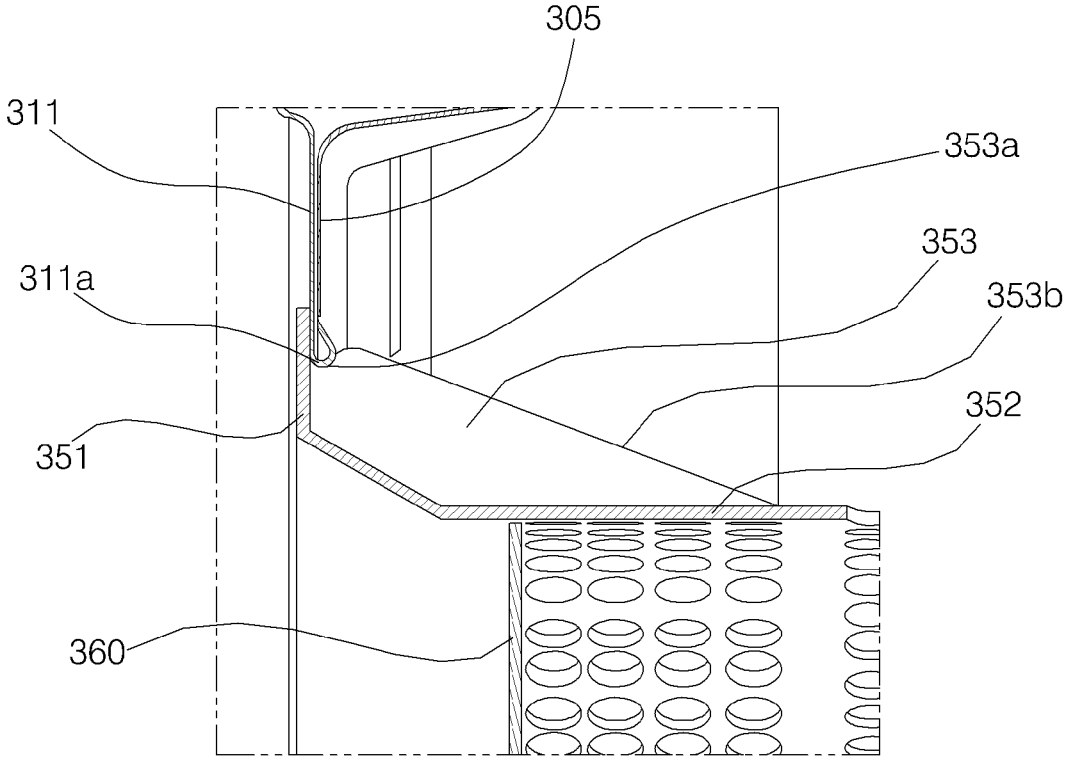
FIG. 20 is an enlarged view of portion A illustrated in FIG. 19.
Figure 21:
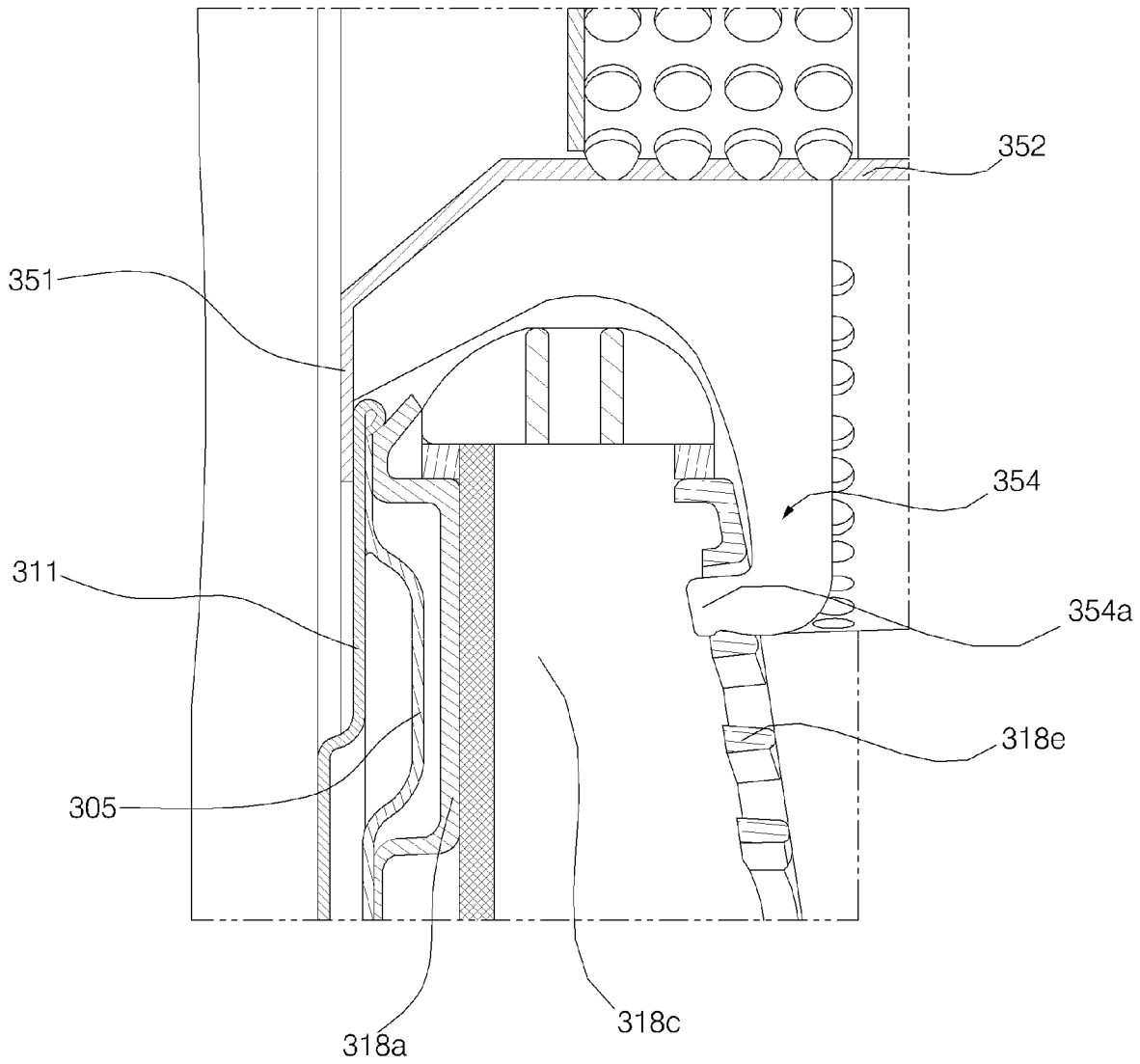
FIG. 21 is a detailed view of portion B illustrated in FIG. 18.

The rear case 318*b* may be provided with an electrode sensor 358 (see FIG. 18). The electrode sensor 358 may include an anode and a cathode which are separated from each other. The anode and the cathode are exposed in the drum 304. When the drum 304 rotates, a garment contacts the anode and the cathode, such that moisture contained in the garment causes both electrodes to be conductive, thereby forming a closed circuit. In this case, resistance value varies depending on the amount of moisture contained in the garment, such that values of current flowing in the circuit vary, and the controller (not shown) may obtain a degree of dryness based on the current values. The controller, in addition to obtaining the degree of dryness, may also control various electronic elements included in the clothes dryer. The controller may include a central processing unit (CPU) and a memory that stores data in a CPU readable manner.

The casing 310 may include a heater 342 to heat air. The rear supporter 308 is provided with an air supply hole 308*h*, and the inner portion of the drum 304 communicates with the air supply duct 327 through the air supply hole 308*h*. The air supply duct 327 guides air inside the casing 310 to the drum 304. When negative pressure is applied in the drum 304 by the suction force of the blower fan 326, hot air heated by the heater 342 is introduced to an inlet 327*a* of the air supply duct 327, and is supplied into the drum 304 through an outlet 327*b* of the air supply duct 327.

Referring to FIGS. 17 to 21, the dryer 300 may optionally include a basket 350*a* to accommodate garments independently from the drum 304. The basket 350*a* may be detachable from the casing 310. When some of the garments to be dried are needed to separately dried, the basket 350*a* is installed to put the garments therein.

A space (i.e., space where the garments are accommodated), which is formed by the basket 350*a*, is at least partially provided inside the drum 304, and the basket 350*a* is provided with a plurality of through-holes 352*h*, through which hot air supplied into the drum 304 is introduced into the space. The basket 350*a* may be detachably connected with the front panel 311. The basket 350*a* is inserted into the introduction port 311*h* formed at the front panel 311. In this case, the basket 350*a* has an opening, which is formed at a front portion thereof and through which clothes are introduced, into the basket 350*a* and the space where clothes are accommodated is located inside the drum 304. The opening of the basket 350*a* is opened and closed by the door 320. While the door 320 is closed, the door glass 322 is extend into the inside of the basket 350*a*.

The basket 350*a* may include a flange 351 having an opening through which clothes are introduced, and an accommodation chamber 352 which is recessed from the flange 351 to form a space to accommodate clothes. The plurality of through-holes 352*h* may be formed at the accommodation chamber 352. While the basket 350*a* is completely mounted, the flange 351 comes into contact with the front panel 311, and the accommodation chamber 352 is placed inside the drum 304.

A basket cover 360 may be further provided, which divides the space in the accommodation chamber 352 into a front region and a rear region. The basket cover 360 is an independent member separate from the basket 350*a*, and may be inserted into or drawn out of the basket 350*a*. After clothes are put into the accommodation chamber 352, the basket cover 360 is inserted, and the door 320 is closed, clothes are placed at the rear side of the basket cover 360 (i.e., rear region), and the door glass 322 is inserted into the front side thereof (i.e., front region). In this manner, even when the door 320 is opened, the basket cover 360 may prevent clothes from falling out of the accommodation chamber 352.

The basket cover 360 is desirably made of a material, such as a synthetic resin or rubber, which may be transformed to some degree. However, the basket cover 360 is not limited thereto, and depending on embodiments, the basket cover 360 may be rotatably connected so as to open and close the accommodation chamber 352.

The basket 350*a* may further include a rib 353, which protrudes from an outer surface of the accommodation chamber 352 in a radial direction. The rib 353 is elongated horizontally, and the front end of the rib 353 is connected with the flange 351. A removable groove 531 (see FIG. 20), into which the circumference of the introduction port 311*h* is inserted, may be formed at the rear side of the flange 351 of the basket 350*a*. While the circumference of the introduction port 311*h* is inserted into the removable groove 353*a*, the flange 351 may be adhered to the front panel 311.

The removable groove 353*a* may be formed at the rib 353. The rib 353 may further protrude outwards in a radial direction from the circumference of the introduction port 311*h*, and the opening of the removable groove 353*a* may be positioned at the protruding portion.

As described above, in a structure where the rib 353 further protrudes outwards in a radial direction from the circumference of the introduction port 311*h*, the circumference of the introduction port 311*h* may interfere with the rib 353 when the basket 350*a* is mounted. However, the rib 353 may be made of a synthetic material, and the entire basket 350*a*, including the rib 353, may be integrally formed of a synthetic resin, such that when the rib 353 interferes with the circumference of the introduction port 311*h*, the basket 350*a* may be transformed to some degree, thereby allowing the circumference of the introduction port 311*h* to be inserted into the removable groove 353*a*.

The rib 353 may have a slope 353*b*, which is tilted such that as the rib 353 nears to the rear side of the removable groove 353*a* from the opening thereof, the rib 353 may be closer to the accommodation chamber 352. In the embodiment, the slope 353*b* is formed until a portion where the slope 353*b* and the accommodation chamber 352 meet. However, the slope 353*b* is not limited thereto, and may be formed only in a section that extends from the opening of the removable groove 353*a*.

When the basket 350*a* is removed from the introduction port 311*h*, a portion from the opening of the removable groove 353*a* to the beginning of the slope 353*b* may be formed to be a curved surface protruding outwards from the rib 353, so that the circumference of the introduction port 311*h* may be smoothly released from the removable groove 353*a*.

When the basket 350*a* is inserted into the introduction port 311*h*, the circumference of the introduction port 311*h* comes into contact with the slope 353*b*; and when the basket 350*a* is continuously pushed, the removable groove 353*a* reaches a position corresponding to the circumference of the introduction port 311*h*, thereby allowing the circumference of the introduction port 311*h* to be inserted into the removable groove 353*a*.

The front panel 311 may be made of a metal plate. When the front panel 311 is formed, an opening corresponding to the introduction port 311 is formed at the metal plate, and the circumference of the opening is curled inwards of the casing 310, thereby forming a hem 112 along the circumference of the introduction port 311*h*. The introduction port 311*h* and an access opening of the drum 304 communicate with each other through the opening 305*h* of the front supporter 305. When viewed from the front side, the introduction port 311*h* is provided inside the opening 305*h*, and the hem 311*a* is provided inside the opening 305*h*.

A plurality of ribs 353 may be formed along the circumference of the accommodation chamber 352. In the embodiment, the rib 353 is provided at the top side, the left side, and the right side of the accommodation chamber 352, and the hem 121 is inserted into the removable groove 353*a* formed at each rib 353, thereby preventing movement of the basket 350*a* to the top side, the left side, and the right side. However, the position and the number of the ribs 353 are not limited thereto.

The basket 350*a* extends from the accommodation chamber 352, and may further include an anchor 354, which hooks onto the grille 318*e*. The grille 318*e* has an opening which opens rearward, and the anchor 354 may include a hook 354*a* which is inserted into the opening at the rear side of the grille 318*e*. Two or more baskets 350*a* may be provided. While the basket 350*a* is completely mounted, the anchor 354 hooks onto the grille 318*e*, thereby preventing rotation of the basket 350*a* inside the introduction port 311*h*. It is desired that there are two or more anchors 354, and a pair of anchors 354 may be provided symmetrically on the left side and the right side when the basket 350*a* is viewed from the front.

The basket 350*a* may be mounted by being diagonally inserted into the introduction port 311*h*, and the anchor 354 hooks onto the grille 318*e*. Then, the basket 350*a* is horizontally arranged, and is pushed into the introduction port 311*h* more deeply. In this case, the hem 311*a* forming the circumference of the introduction port 311*h* interferes with or otherwise contacts the slope 353*b* of the rib 353, but when the basket 350*a* is further deeply pushed, the interference may be overcome, and the hem 311*a* may be inserted into the removable groove 353*a*, thereby completing mounting of the basket 350*a*.

Figure 22:
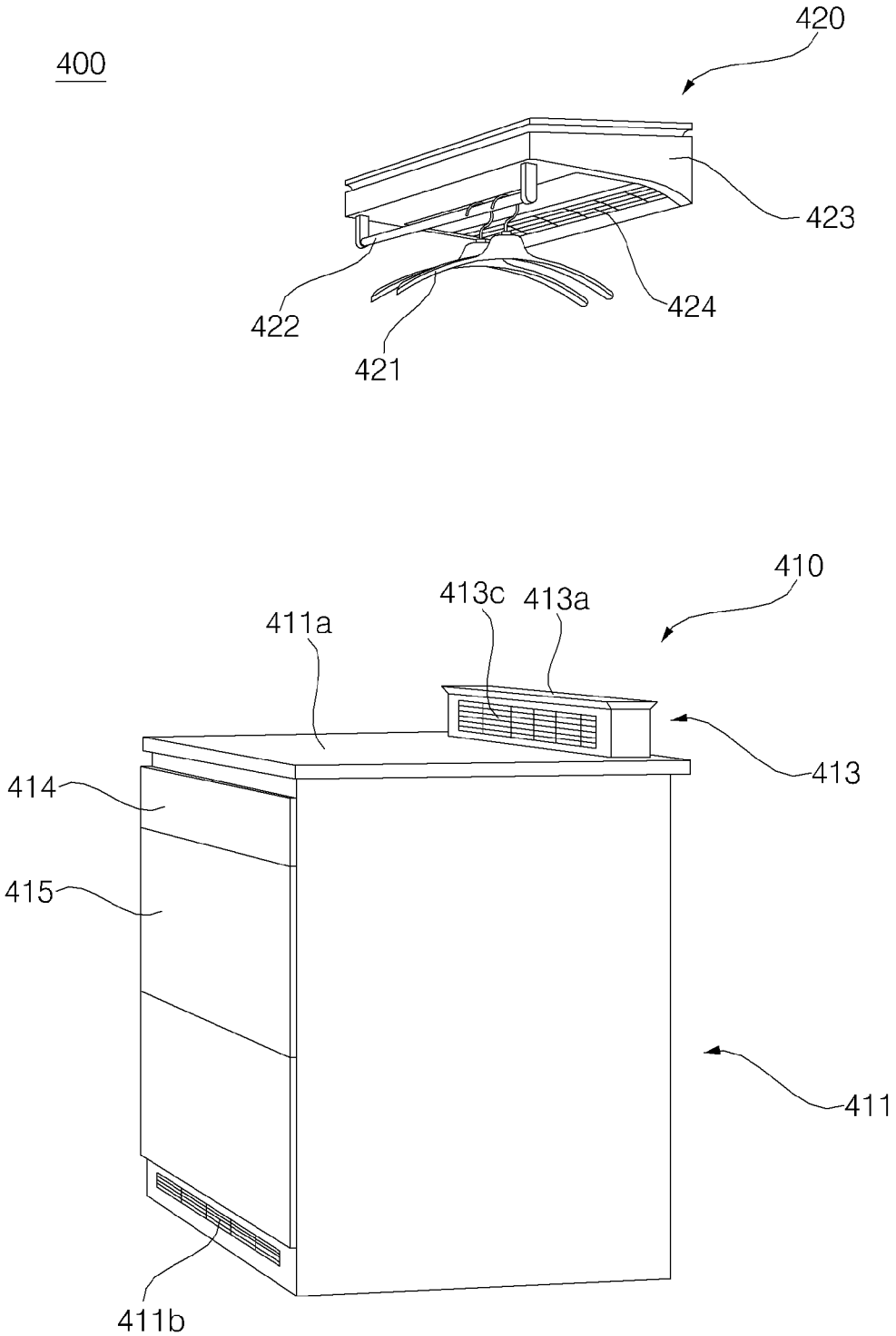
FIG. 22 is a perspective view illustrating an operation state of an iron part illustrated in FIG. 1.
Figure 23:
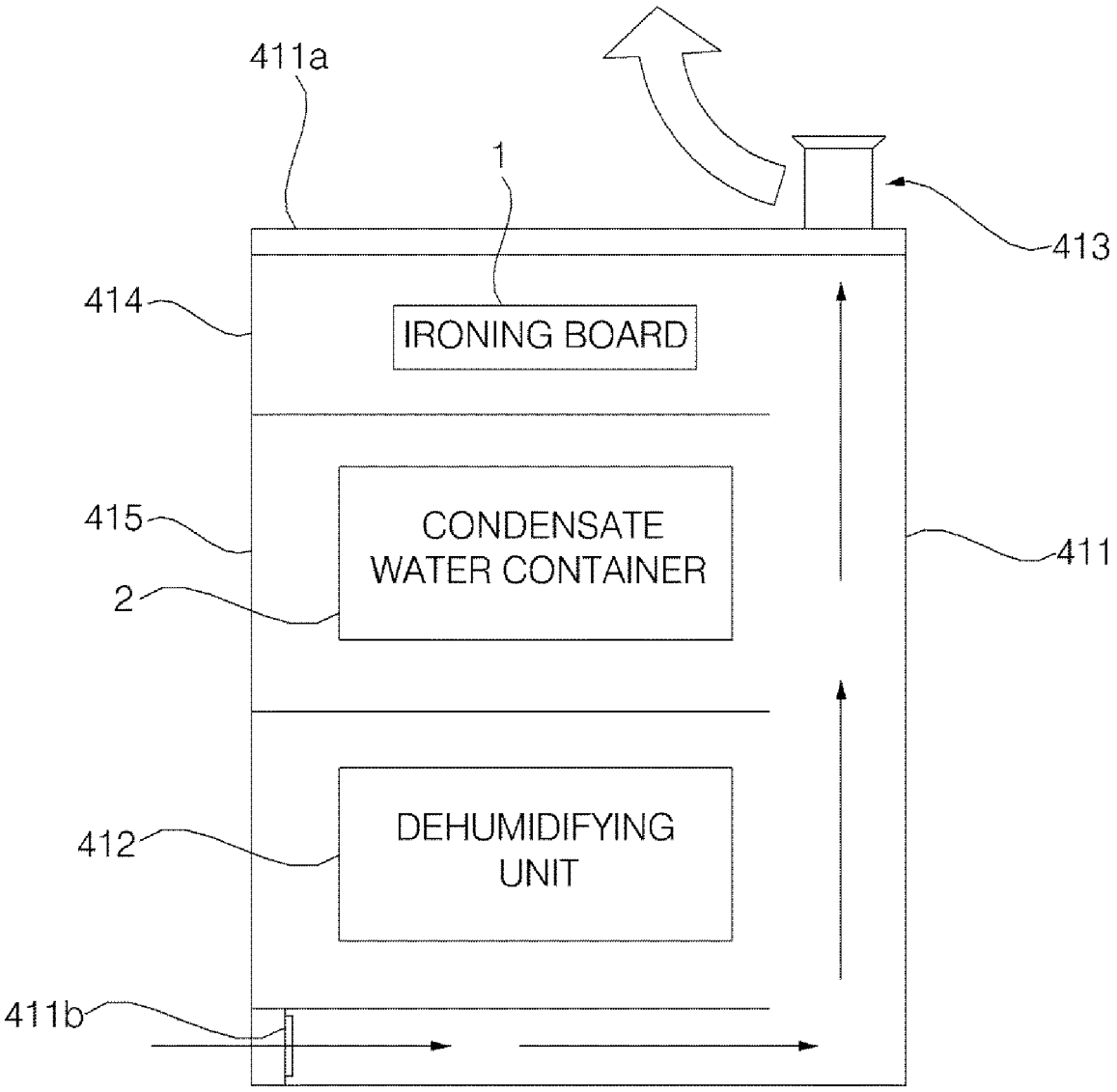
FIG. 23 is a side cross-sectional view of a dehumidifying and ironing module illustrated in FIG. 22.
Figure 24:
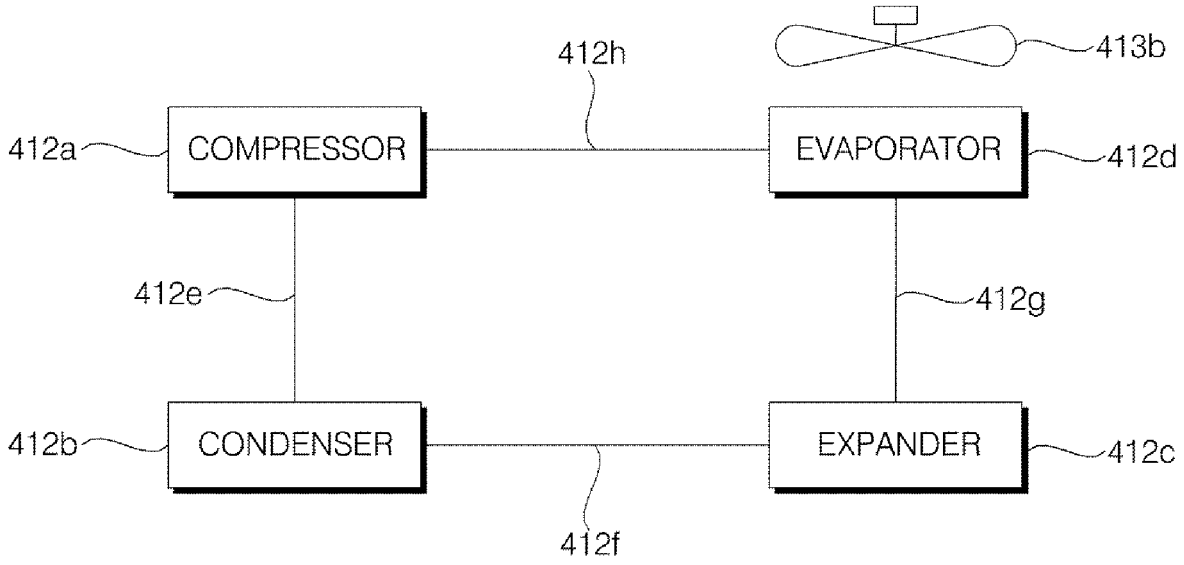
FIG. 24 is a diagram illustrating a dehumidifying unit illustrated in FIG. 23.
Figure 25:
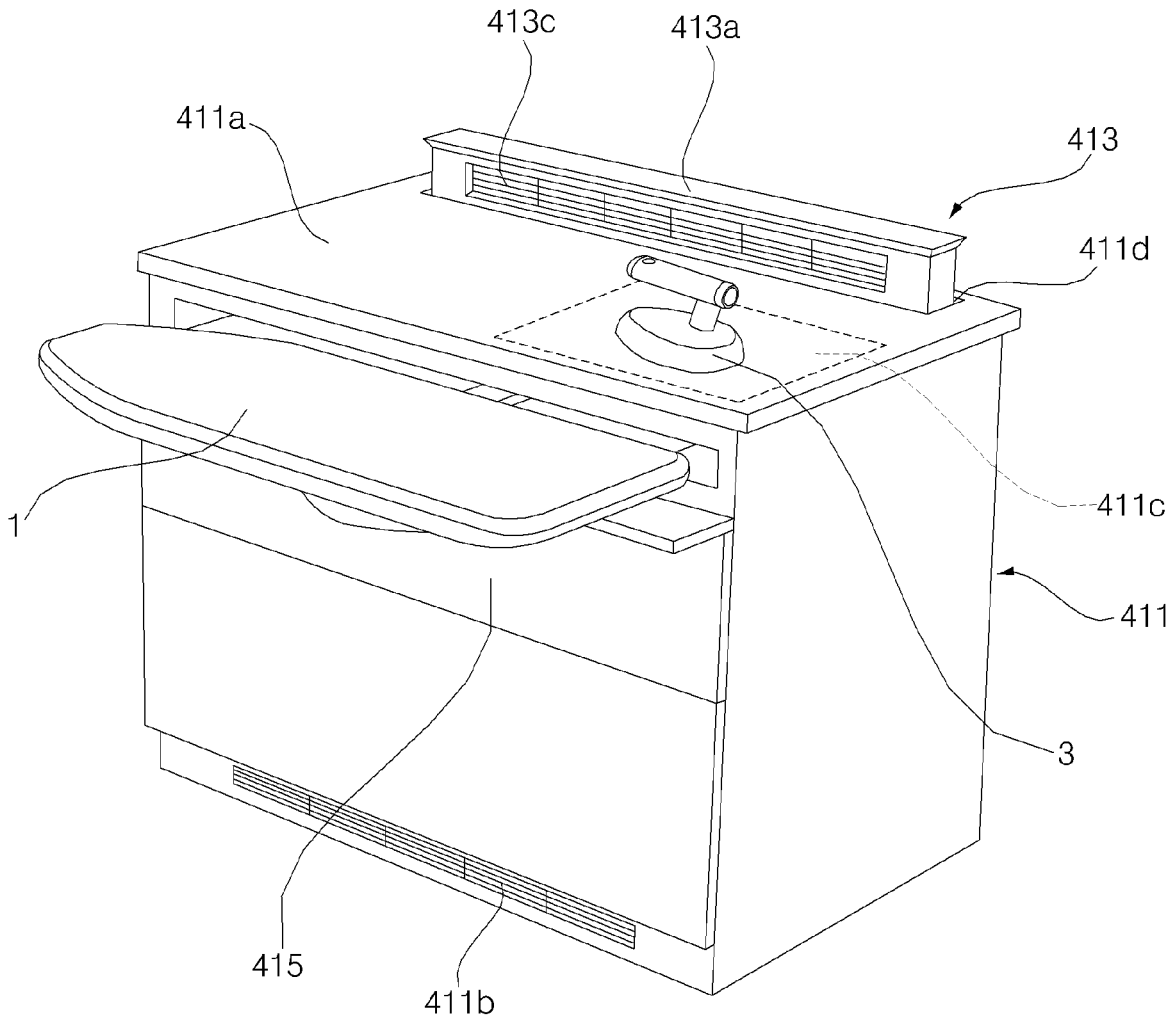
FIG. 25 is a diagram illustrating a state where a first storage space is opened in the dehumidifying and ironing module illustrated in FIG. 22.
Figure 26:
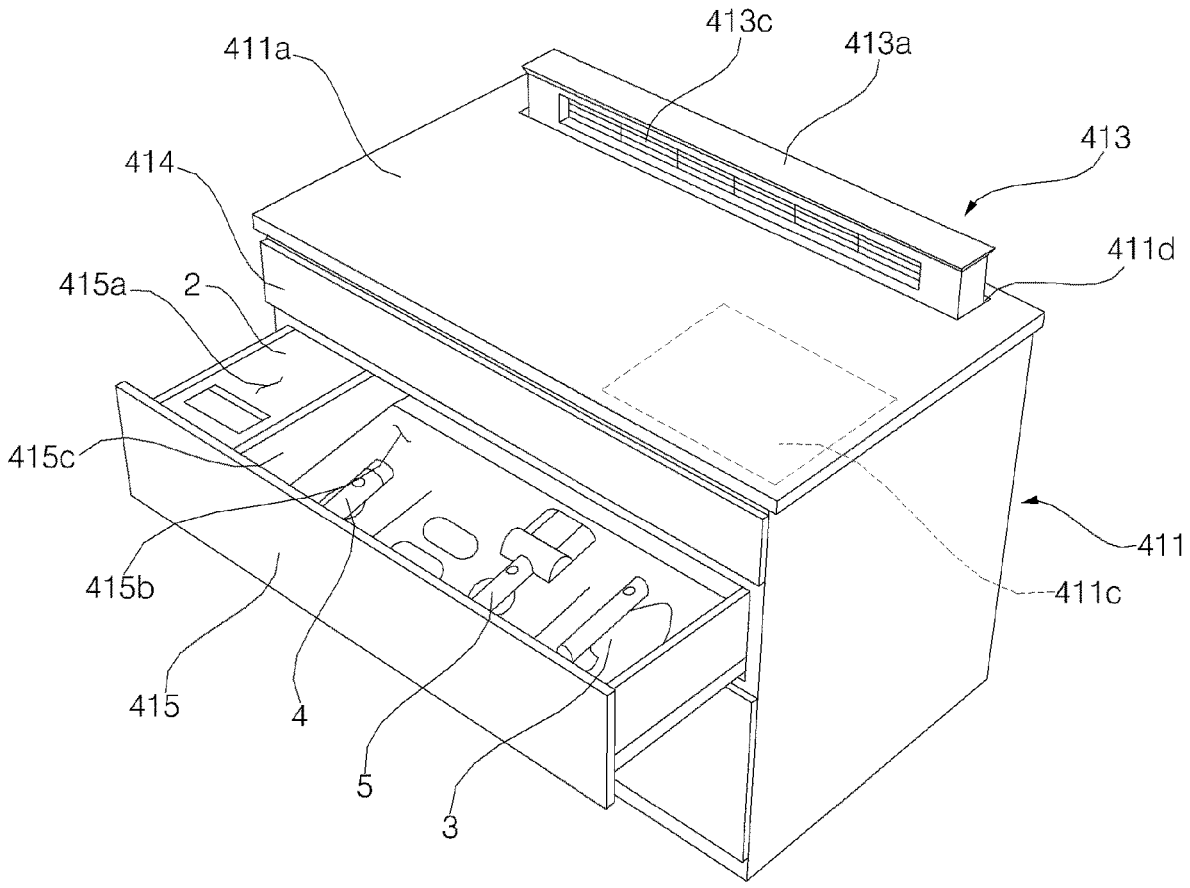
FIG. 26 is a diagram illustrating a state where a second storage space is opened in the dehumidifying and ironing module illustrated in FIG. 22.
Figure 27:
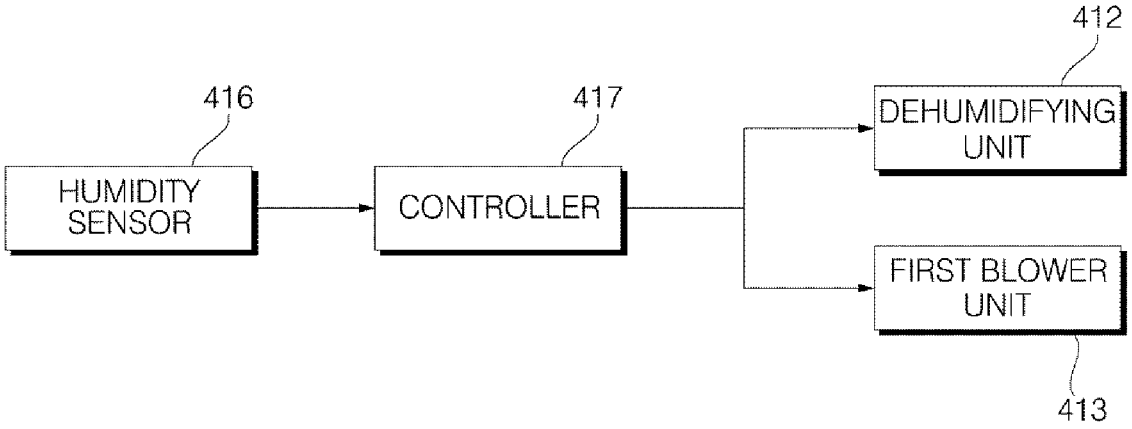
FIG. 27 is a control block diagram illustrating an ironing part.

The ironing part (or ironing station) 400 may be described as follows. FIG. 22 is a perspective view illustrating an operation state of the ironing part 400, FIG. 23 is a side cross-sectional view of a dehumidifying and ironing module 410, and FIG. 24 is a diagram illustrating an example of an dehumidifying unit 412 included in the dehumidifying and ironing module 410. FIG. 25 is a diagram illustrating a state where a first storage space 414 is opened in the dehumidifying and ironing module 410, and FIG. 26 is a diagram illustrating a state where a second storage space 415 is opened in the dehumidifying and ironing module 420. FIG. 27 is a control block diagram for the ironing part 400.

Referring to FIGS. 22 to 27, the ironing part 400 includes a dehumidifying and ironing module 410 and a drying module 420. The dehumidifying and ironing module 410 may be installed on an indoor floor surface, and the drying module 420 may be installed on the indoor wall or the ceiling. The dehumidifying and ironing module 410 may suction and dehumidify indoor air, and may discharge the dehumidified air. Further, the dehumidifying and ironing module 410 may provide a horizontal surface to iron laundry.

The drying module 420 includes a hanging part (or hanging bar) 422, on which a hanger 421 is hung, and may suction indoor air to send the suctioned air to laundry hung on the hanger 421. The laundry on the hanger 421 may be dried by air sent by the drying module 420. In another example, the laundry may be hung on the hanging part 422.

The dehumidifying and ironing module 410 includes a cabinet 411, a dehumidifying unit (or dehumidifier) 412 installed at the cabinet 411, and a first blower unit (or first blower) 413 installed at the top of the cabinet 411. The cabinet 411 may be formed in a hexahedral (or box-like) shape and has an open front surface and a cavity. The cabinet 411 may include a second upper panel 411*a* which is provided on the top of the cabinet 411. The second upper panel 411*a* may form the top surface of the cabinet 411, and is formed in a substantially flat rectangular shape. The top surface of the cabinet 411 is formed to be substantially flat with the second upper panel 411*a*. A user may put an ironing board 1 on the flat top surface of the cabinet 411, and position laundry on the ironing board 1 to iron the laundry.

A first storage space 414 and a second storage space 415 may be provided at the open front surface of the cabinet 411. The first storage space 414 may be provided above the second storage space 415; and the second storage space 415 may be provided below the first storage space 414. The first storage space 414 may be opened and closed by sliding forward and rearward in the cabinet 411, and the second storage space 415 may also be opened and closed by sliding forward and rearward in the cabinet 411. When opened, the first storage space 414 may protrude forward from the cabinet 411, and when closed, the first storage space 415 may be inserted into the cavity of the cabinet 411. When opened, the second storage space 415 may also protrude forward from the cabinet 411, and when closed, the second storage space 415 may also be inserted into the cavity of the cabinet 411.

The first storage space 414 may store the ironing board 1. When a user wishes to iron laundry, the user may open the first storage space 414, take out the ironing board 1, and put the ironing board 1 on the top surface of the cabinet 411 to iron the laundry.

The second storage space 415 may include a first storage part (or first storage region) 415*a* and a second storage part (or second storage region) 415*b*. The first storage part 415*a* and the second storage part 415*b* may be separated by a partition wall 415*c*. The first storage part 415*a* may include a condensate water container 2, and the second storage part 415*b* may include at least one of an iron 3, a steamer 4, or a remover (or fluff remover) 5.

The condensate water container 2 may be a container or bin that stores condensate water generated when the dehumidifying unit 412 dehumidifies indoor air.

The iron 3 may be a device to iron laundry by converting electric power into heat. The iron 3 may have a stream spray function. A user may put the laundry on the ironing board 1, to iron the laundry by using the iron 3.

The steamer 4 is a device the spray high-temperature steam into the laundry. A user may use the steamer to spray high-temperature steam on the laundry hung on the drying module 420 to iron the laundry.

The remover 5 is a device for remove foreign materials, such as fluff, from the laundry. For example, the remover 5 may shave a clothing surface to remove fluff (or lint) extending from the surface. While hanging the laundry on the drying module 420, a user may rub the remover 5 on the laundry to remove fluff from the laundry.

A wireless charging unit (or wireless charger) 411*c* may be installed on the top of the cabinet 411. The wireless charging unit 411*c* may include a wireless inductive charging coil (not shown). The wireless charging unit 411*c* may be positioned such that a top surface of the wireless charging unit 411*c* is at a substantially similar height as a top surface of the upper panel 411*a* of the cabinet 411. The wireless charging unit 411*c* may be inserted into the second upper panel 411*a*. The devices in the second storage space 415*b*, such as the iron 3, the steamer 4, and the remover 5, may be placed on the top of the wireless charging unit 411*c* for wireless charging. The iron 3, the steamer 4, and the remover 5 each have a battery, and desirably a coil which receives an inductive current from the wireless charging coil of the wireless charging unit 411*c* to charge the battery.

A suction grille 411*b* may be provided at the cabinet 411. The suction grille 411*b* may form one or more air inlets into a central cavity of the cabinet 411. The suction grille 411*b* may be referred to as the air inlet. In the embodiment, the air inlet is formed on the front surface of the cabinet 411, but is not limited thereto, and may be formed on at least one of the front surface, the lateral surface, and the rear surface of the cabinet 411. Hereinafter, the air inlet is described as being formed on the front surface of the cabinet 411. The suction grille 411*b* is provided below the second storage space 415. Air may be suctioned into the cabinet 411 through the suction grille 411*b*.

The dehumidifying unit 412 is provided inside the cabinet 411 to dehumidify air suctioned into the cabinet 411 through the suction grille 411*b*. The dehumidifying unit 412 may include a cooling cycle circuit using a refrigerant. For example, the dehumidifying unit 412 may include a compressor 412*a*, a condenser (or condenser coil) 412*b*, an expander (or expansion valve) 412*c*, and an evaporator 412*d*. The compressor 412*a* may compress a refrigerant; the condenser 412*b* may condense the refrigerant compressed by the compressor 412*a*; the expander 412*c* may expand the refrigerant condensed by the condenser 412*b*; and the evaporator 412*d* may evaporate the refrigerant expanded by the expander 412*c*. In other examples, the dehumidifying unit 412 may include a heater to warm and dry the air or a desiccant.

The evaporator 412*d* may cool and dehumidify the air suctioned into the cabinet 411 through the suction grille 411*b* by heat-exchanging. When the evaporator 412*d* cools the air inside the cabinet 411, water vapor contained in the air of the cabinet 411 is cooled and changed into condensate water, and the condensate water may be formed on the evaporator 412*d*. The condensate water container 2 is provided below the evaporator 412*d* to receive and store the condensate water dropping from the evaporator 412*d*.

The compressor 412*a* and the condenser 412*b* may be connected to each other through a first refrigerant pipe 412*e*. The condenser 412*b* and the expander 412*c* may be connected to each other through a second refrigerant pipe 412*f*. The expander 412*c* and the evaporator 412*d* may be connected to each other through a third refrigerant pipe 412*g*. The evaporator 412*d* and the compressor 412*a* may be connected to each other through a fourth refrigerant pipe 412*h*. The refrigerant may circulate by sequentially passing the compressor 412*a*, the first refrigerant pipe 412*e*, the condenser 412*b*, the second refrigerant pipe 412*f*, the expander 412*c*, the third refrigerant pipe 412*e*, the evaporator 412*d*, and the fourth refrigerant pipe 412*h*.

The first blower unit 413 may discharge the air, dehumidified in the cabinet 411 by the dehumidifying unit 412, to the outside of the cabinet 411. When operating, the first blower unit 413 may be drawn out of the cabinet 411, and when stopping the operation, the first blower unit 413 may be inserted into the cabinet 411. When operating, the first blower unit 413 may be drawn out of the cabinet 411 to protrude upward from the cabinet 411. When stopping the operation, the first blower unit 413 is inserted into the cabinet 411, such that the top surface of the first blower unit 413 is horizontal to the top surface of the cabinet 411.

An access hole 411*d*, through which the first blower unit 413 may pass, is formed on the top of the cabinet 411. The access hole 411*d* may be formed close to a rear end of the second upper panel 411*a*, such that a sufficient area may be provided on the second upper panel 411*a* to place the ironing board 1 in front of the access hole 411*d*.

The first blower unit 413 may include a case 413*a*, and a fan 413*b* which suctions the air, dehumidified in the cabinet 411 by the dehumidifying unit 412, into the case 413*a*. A discharge grille 413*c* may be installed at the front surface of the case 413*a*. The discharge grille 413*c* may form one or more air outlets. The discharge grille 413*c* may be referred to as the air outlet. The case 413*a* may have an open lower end, so that the dehumidified air, sent by the fan 413*b*, may enter the case 413*a*.

The fan 413*b* may be installed inside the cabinet 411, and may rotate by a driving force of a motor (not shown). The fan 413*b* may be provided above the evaporator 412*d*, and may be provided below the case 413*a*. The fan 413*b* may be vertically interposed between the case 413*a* and the evaporator 412*d*. The fan 413*b* may have a rotation axis which extends vertically. When rotating, the fan 413*b* may suction the air, which is dehumidified in the cabinet 411 by the evaporator 412*d*, to send the suctioned dehumidified air into the case 413*a*; and the case 413*a* may discharge the dehumidified air sent by the fan 413*b* forward of the case 413*a* through the discharge grille 413*c*.

When the fan 413*b* operates, the case 413*a* may protrude upward from the cabinet 411 through the access hole 411*d* formed on the second upper panel 411*a*, so as to discharge the dehumidified air sent by the fan 413*b* to the outside of the case 413*a* through the discharge grille 413*c*. Further, when the fan 413*b* stops operating, the case 413*a* may be re-inserted into the cabinet 411 through the access hole 411*d*. When the case 413*a* is completely inserted into the cabinet 411 through the access hole 411*d*, the top surface of the case 413*a* is provided horizontal to the top surface of the second upper panel 411*a*. The case 413*a* may be installed to be movable upward and downward of the second upper panel 411*a*, so that when the fan 413*b* operates, the case 413*a* may protrude upward from the cabinet 411, and when the fan 413*b* stops operating, the case 413*a* may be reinserted into the case 411.

The drying module 420 may include a second blower unit 424 and a hanging part 422 installed at the second blower unit 424. The second blower unit 424 suctions indoor air to send the air to laundry hung on the hanging part 422 by using the hanger 421. The laundry on the hanging part 422 may be dried by the air sent by the second blower unit 424. As air surrounding the laundry remains to be dry by using the dehumidified air is discharged by the first blower unit 413, and the laundry is dried by the air discharged by the second blower unit 424, a drying time of the laundry may be reduced.

The second blower unit 424 may include a housing (not shown) having an air inlet (not shown) and an air outlet (not shown); and a fan (not shown) which is provided inside the housing to suction air, suctioned into the housing through the air inlet, and to send the air through the air outlet. A discharge grille 424 may be provided at a rear lower portion of the second blower unit 424. The discharge grille 424 may form one or more air inlets. The discharge grille 424 may be tilted with a front end being provided higher than a rear end, so as to discharge air forward and downward toward the hung laundry.

The first blower unit 413 may be provided below and rearward of the hanging part 422, such that the first blower unit 413 may discharge the dehumidified air forward and around the laundry. Further, the second blower unit 424 may discharge air forward and downward from the rear side of the hanging part 422 and toward the laundry.

The first blower unit 413 discharges the dehumidified air downward of the laundry, and the second blower unit 424 discharges air toward a portion where the dehumidified air, discharged by the first blower unit 413, is present. Accordingly, the air, which is sent by the second blower unit 424 to the laundry hung on the hanger 421, is mixed with vapor generated in the course of drying the laundry, and then meets the dehumidified air discharged by the first blower unit 413, thereby reducing a drying time of the laundry.

The ironing part 400 may further include a humidity sensor 416 and a controller 417. The humidity sensor 416 may sense humidity values of surrounding air. The humidity values sensed by the humidity sensor 416 may be input to the controller 417. Upon receiving the humidity values sensed by the humidity sensor 416, the controller 417 may compare the humidity values with a predetermined value or predetermined humidity level.

When the humidity value measured by the humidity sensor 416 is equal to or greater than the predetermined value, the controller 417 may operate the dehumidifying unit 412 and the first blower unit 413. Furthermore, when the humidity value input detected by the humidity sensor 416 is lower than the predetermined value, the controller 417 may stop the dehumidifying unit 412 and the first blower unit 413. Accordingly, when the dryer 400 dries the laundry, the dehumidifying unit 412 and the first blower unit 413 repeatedly operate and stop automatically according to the surrounding humidity of the laundry, thereby reducing power consumption.

The humidity sensor 416 may be installed close to the laundry hung on the drying module 420, so that the dehumidifying unit 412 and the first blower unit 413 may operate automatically only when the humidity of the surrounding air of the laundry is equal to or greater than the predetermined value. Accordingly, the humidity sensor 416 may be installed at the second upper panel 411*a* on the top of the cabinet 411.

The present disclosure provides a laundry treatment apparatus which may sequentially perform pre-washing, main washing, drying, and ironing in one place. In accordance with an aspect of the embodiments of the disclosure, there is provided a laundry treatment apparatus including: a pre-washer configured to perform pre-washing of laundry in an accommodation space which accommodates the laundry and has a sink bowl having an open top portion; a main washer which is provided beside the pre-washer, and performs main washing, rinsing, and spin-drying of the laundry when the laundry, pre-washed by the pre-washer, is introduced into the main washer from a front side; a dryer which is provided beside the main washer, and performs drying of the laundry when the laundry, spin-dried by the main washer, is introduced into the dryer from a front side; an ironing part which is provided beside the dryer, and has a flat top surface to iron the laundry dried by the dryer; a first upper panel which is provided on a top portion of the main washer and the dryer and has a flat top surface; a second upper panel which forms the top surface of the ironing part; and a lid which is provided on a top portion of the pre-washer to open and close the accommodation space, and a top surface of which is at the same height as the top surface of the first upper panel and a top surface of the second upper panel. Thus, pre-washing, main washing, drying, and ironing may be sequentially performed in one place, which may be provided to a user as an integrated process.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment apparatus comprising:

a pre-washing station that includes a sink bowl having an open top over an accommodation space to receive laundry for pre-washing;

a washer which is provided beside the pre-washing station, and performs washing, rinsing, and spin-drying of the laundry when the laundry is introduced into the washer;

a dryer which is provided beside the washer, and performs drying of the laundry when the laundry is introduced into the dryer;

an ironing station which is provided beside the dryer, and has a flat top surface for ironing of the laundry;

a first upper panel which is provided on top of the washer and the dryer and has a flat top surface;

a second upper panel which forms the top surface of the ironing station;

a lid which is provided on top of the pre-washing station to open and close the accommodation space;

a cabinet included in the pre-washing station and having the sink bowl and the lid on a top thereof;

a faucet which is provided at the sink bowl and supplies wash water to the accommodations space; and a rear panel which is provided at the top of the cabinet and rear of the lid, wherein the faucet includes:

a horizontal arm which is configured to be received in a faucet receiving groove formed at the sink bowl; and an extending arm which extends downward from the horizontal arm to be provided at a rear side of the sink bowl, wherein a latch groove is provided on a rear surface of the extending arm, wherein a latch protrusion is provided at the rear panel and is latched into the latch groove when the faucet protrudes from the faucet receiving groove, and wherein a top surface of the lid is at a same height as the top surface of the first upper panel and a top surface of the second upper panel.

2. The laundry treatment apparatus of claim 1, further comprising:

a first side panel provided at a side of the pre-washing station to form one side of the laundry treatment apparatus; and a second side panel provided at a side of the ironing station to form another side of the laundry treatment apparatus.

3. The laundry treatment apparatus of claim 1, further comprising:

a first door which is provided at a front of the washer, and opens and closes the front of the washer; and a second door which is provided at a front of the dryer, and opens and closes the front of the dryer.

4. The laundry treatment apparatus of claim 1, wherein the pre-washing station further includes:

a water stream generator which is provided on at least one side of the accommodation space, and generates a water stream in the wash water in the accommodation space.

5. The laundry treatment apparatus of claim 4, wherein the water stream generator sprays air into the wash water in the accommodation space.

6. The laundry treatment apparatus of claim 4, wherein:

the faucet is installed to be movable upward and downward, such that when the lid closes the open top of sink bowl, the faucet is received in the faucet receiving groove and is positioned below the lid.

7. The laundry treatment apparatus of claim 1, wherein the sink bowl further includes a plurality of washing ribs formed at a front surface of the accommodation space.

8. The laundry treatment apparatus of claim 1, further comprising a drawer type washer which is provided below the sink bowl, moves inwards and outwards of the cabinet, and performs washing, rinsing, and spin-drying of the laundry.

9. The laundry treatment apparatus of claim 1, wherein the ironing station includes:

a ironing station cabinet which has an air inlet, and a top surface of which is formed by the second upper panel;

a dehumidifier which is provided inside the ironing station cabinet, and dehumidifies air suctioned into the ironing station cabinet through the air inlet;

a first blower which is provided at the top surface of the ironing station cabinet, and discharges the air dehumidified in the ironing station cabinet by the dehumidifier; and a second blower which is provided over the ironing station cabinet, and sends air toward the laundry when hung at the ironing station.

10. The laundry treatment apparatus of claim 9, wherein:

an access hole, through which the first blower passes, is provided at the top of the ironing station cabinet; and the first blower which, when operating, is drawn out of the ironing station cabinet through the access hole and, when not operating, is inserted into the ironing station cabinet through the access hole.

11. The laundry treatment apparatus of claim 9, wherein the first blower includes:

a case having an air outlet; and a fan which suctions the air dehumidified by the dehumidifier, and sends the dehumidified air into the case.

12. The laundry treatment apparatus of claim 9, wherein:

the first blower is provided below and rearward of the laundry when hung in the ironing station, and discharges the dehumidified air forward; and the second blower discharges air forward and downward from a rear of the laundry when hang in the ironing station.

13. The laundry treatment apparatus of claim 9, wherein the dehumidifier includes:

a compressor that compresses a refrigerant;

a condenser that condenses the refrigerant that passes through the compressor;

an expander that expands the refrigerant that passes through the condenser;

an evaporator that evaporates the refrigerant that passes through the expander and moves to the compressor, and dehumidifies air suctioned into the ironing station cabinet.

14. The laundry treatment apparatus of claim 9, further comprising a wireless charger which is installed at the top of the ironing station cabinet, wherein a top surface of wireless charger is positioned at a same height as a top surface of the ironing station cabinet.

15. The laundry treatment apparatus of claim 9, further comprising a first storage space which is opened and closed by sliding forward and rearward in the ironing station cabinet, and which stores an ironing board.

16. The laundry treatment apparatus of claim 9, further comprising a second storage space which is opened and closed by sliding forward and rearward in the ironing station cabinet, wherein the second storage space has a first storage region including a condensate water container which stores condensate water generated by the dehumidifier.

17. The laundry treatment apparatus of claim 16, wherein the second storage space further includes a second storage region which stores at least one of an iron, a streamer, or a fluff remover.

18. The laundry treatment apparatus of claim 9, further comprising:

a humidity sensor which detects a humidity of air adjacent to the laundry hung at the ironing station; and a controller, which in response to the humidity detected by the humidity sensor being equal to or greater than a prescribed value, activates the dehumidifier and the first blower, and in response to the humidity sensed by the humidity sensor being lower than the prescribed value, deactivates the dehumidifier and the first blower.

* * * * *